US010532842B1

(12) United States Patent
Zoss et al.

(10) Patent No.: US 10,532,842 B1
(45) Date of Patent: Jan. 14, 2020

(54) TAPE APPLICATOR WITH TAPE END FOLD AND ASSOCIATED CASE SEALING MACHINE AND METHOD

(71) Applicant: WEXXAR PACKAGING, INC., Delta (CA)

(72) Inventors: Jeremy K. Zoss, San Antonio, TX (US); Thomas E. Lyons, Jr., Rio Medina, TX (US); Stephen L. Wiedmann, Boerne, TX (US)

(73) Assignee: WEXXAR PACKAGING, INC., Delta, BC (CA)

( * ) Notice: Subject to any disclaimer, the term of this patent is extended or adjusted under 35 U.S.C. 154(b) by 478 days.

(21) Appl. No.: 15/254,448

(22) Filed: Sep. 1, 2016

Related U.S. Application Data

(63) Continuation of application No. 15/145,344, filed on May 3, 2016, now abandoned.

(60) Provisional application No. 62/156,359, filed on May 4, 2015.

(51) Int. Cl.
*B65B 51/06* (2006.01)
*B65H 35/00* (2006.01)
*B65H 35/06* (2006.01)

(52) U.S. Cl.
CPC ..... *B65B 51/067* (2013.01); *B65H 35/0086* (2013.01); *B65H 35/06* (2013.01)

(58) Field of Classification Search
CPC ..... B65B 51/067; B65B 51/06
USPC ..... 53/133.3, 136.4, 412; 156/477.1; 493/117
See application file for complete search history.

(56) References Cited

U.S. PATENT DOCUMENTS

| | | | | | |
|---|---|---|---|---|---|
| 2,309,093 | A | | 1/1943 | Borden | |
| 2,526,494 | A | | 10/1950 | McNeil | |
| 2,581,190 | A | | 1/1952 | Hodges | |
| 2,911,214 | A | | 11/1959 | Sherbrook | |
| 3,355,995 | A | | 12/1967 | Borkmann et al. | |
| 3,389,039 | A | | 6/1968 | Steckler | |
| 3,810,567 | A | | 5/1974 | Malcolm | |
| 4,039,367 | A | * | 8/1977 | Warshaw | B65B 51/067 156/486 |
| 4,061,526 | A | * | 12/1977 | Warshaw | B65B 51/067 156/468 |
| 4,227,955 | A | * | 10/1980 | Woods | B65B 51/067 156/269 |
| 4,253,905 | A | | 3/1981 | Regan | |
| 4,341,587 | A | | 7/1982 | Regan | |
| 4,437,854 | A | | 3/1984 | Knoop | |
| 4,540,393 | A | | 9/1985 | Knoop | |
| 4,576,674 | A | | 3/1986 | Le Tarte | |
| 4,606,784 | A | | 8/1986 | Glans et al. | |
| 4,634,415 | A | | 1/1987 | Knoop | |
| 4,725,218 | A | | 2/1988 | Timmons et al. | |
| 4,759,819 | A | | 7/1988 | Ingram | |
| 4,816,109 | A | * | 3/1989 | Ingram | B65B 51/06 156/443 |
| 4,821,487 | A | * | 4/1989 | James | B65B 51/067 156/477.1 |

(Continued)

*Primary Examiner* — Gloria R Weeks
*Assistant Examiner* — Dariush Seif
(74) *Attorney, Agent, or Firm* — Thompson Hine L.L.P.

(57) ABSTRACT

An adhesive tape application device of a case sealing machine for sealing cases automatically and folding over the end of the adhesive tape to form a grippable non-adhesive tape end portion for easy peeling.

13 Claims, 22 Drawing Sheets

(56) References Cited

U.S. PATENT DOCUMENTS 4,824,427 A * 4/1989 Smillie, III ..... B65H 35/0026 225/25
4,869,769 A 9/1989 DiRusso, Jr. et al.
4,889,581 A * 12/1989 Ulrich ..... B65B 51/067 53/133.3
4,944,720 A 7/1990 Suhr
4,964,942 A 10/1990 Tsuda
4,978,330 A 12/1990 Suhr
5,173,140 A * 12/1992 Vasilakes ..... B65B 51/067 156/212
5,184,997 A * 2/1993 James ..... B65B 51/067 229/125.39
5,318,658 A * 6/1994 Goodman ..... B65B 51/067 156/468
5,405,471 A 4/1995 LeMaster
5,662,578 A 9/1997 Phelps
5,792,310 A 8/1998 Thompson et al.
6,047,882 A * 4/2000 Sin ..... B65D 5/0236 229/125.32
6,276,112 B1 * 8/2001 Mori ..... B65B 51/067 53/136.4
6,502,616 B1 1/2003 Row
6,571,848 B2 * 6/2003 Tsuken ..... B65B 51/067 156/361
6,824,637 B2 11/2004 Mullet et al.
6,945,297 B1 9/2005 Gonzalez et al.
7,121,312 B2 * 10/2006 Yu ..... B65H 35/0033 156/459
7,287,360 B2 10/2007 Makar et al.
7,334,620 B2 2/2008 Imazeki
7,357,285 B2 4/2008 Namekawa et al.
7,493,741 B1 * 2/2009 Chiu Chen ..... B65B 51/067 156/468
7,537,036 B2 5/2009 Namekawa et al.
7,555,874 B2 * 7/2009 Chu ..... B65B 51/067 493/183
7,712,505 B2 * 5/2010 Yamada ..... B65H 35/0033 156/443
7,828,708 B2 11/2010 Huang et al.
8,393,375 B2 3/2013 Lam
9,327,935 B2 5/2016 Chern et al.
9,370,897 B1 6/2016 Dinsmore
2001/0000096 A1 4/2001 Tolerico et al.
2002/0005258 A1 * 1/2002 Tsuken ..... B65B 51/067 156/510
2002/0121169 A1 9/2002 LeMoine
2004/0238109 A1 12/2004 Gonzalez
2006/0113043 A1 6/2006 Imazeki
2006/0118245 A1 6/2006 Imazeki
2006/0131356 A1 * 6/2006 Imazeki ..... B65H 35/0026 225/6
2006/0175017 A1 8/2006 Namekawa et al.
2009/0084504 A1 * 4/2009 Lam ..... B65B 51/067 156/538
2016/0122151 A1 5/2016 Vulpitta et al.
2016/0159604 A1 6/2016 Vulpitta et al.

* cited by examiner

TAPE APPLICATOR WITH TAPE END FOLD AND ASSOCIATED CASE SEALING MACHINE AND METHOD

CROSS-REFERENCES

This application is a continuation of U.S. application Ser. No. 15/145,344, filed May 3, 2016, which in turn claims the benefit of U.S. Provisional Application Ser. No. 62/156,359, filed May 4, 2015, both of which are incorporated herein by reference.

TECHNICAL FIELD

This application relates generally to an adhesive tape application device and, more specifically, to a tape application device that can fold up the end of the tape so as to form a non-adhesive portion to facilitate easy peeling off of the adhesive tape when needed to open a case to which the tape has been applied.

BACKGROUND

In the packaging industry, using adhesive tape to seal a case in order to protect the product inside the case is widely known. A common problem that follows the use of adhesive tape to seal cases is that it is very difficult to peel the tape off of the case when opening of the case is desired. Insertion of a cutter into the flap gap between the two major flaps to cut the tape is a common way to solve the problem, but sometimes this will undesirably cut or otherwise damage the products inside the case.

Known case tape applicators normally do not possess "easy peel off" functionality to make adhesive more easier to peel off. Several attempts can be found in U.S. Pat. Nos. 7,334,620; 7, 357, 285; 7,537,036 and US Patent Appln. No. 2006/013,1356. All of these tape applicators are manual tape applicators and not used in a case sealing machine. The idea behind these tape applicators is that they try to form one non-adhesive long side or edge of an adhesive tape so that it can be peeled off from the long side of the tape. In another attempt found in U.S. Pat. No. 8,393,375, a tape applicator is designed to be used in a case sealing machine, and can fold up both long sides of an adhesive tape to form two non-adhesive sides for easy peel off.

A common problem with the above mentioned attempts is that at least one whole long side of the tape is non-adhesive (and U.S. Pat. No. 8,393,375 two whole sides). When the sealed cases are stacked, if a worker puts a case on the top of another case and pushes the upper case along the top surface of the lower case, then the non-adhesive tape side of the lower case will be push against the bottom of the upper case, in which case the non-adhesive side of the lower case may be flipped over and stick on the bottom of the upper case. As a result, the non-adhesive tape side edge on the lower case will be peeled off by the push force.

Another problem is that, because the long side edge of the tape is formed as non-adhesive, the surface adhesive area of a tape for sealing the case is reduced. In other words, the case will be easier to open by applying slight force against the flap gap, making it easier for someone to steal the products inside the case. This problem is more prevalent in the U.S. Pat. No. 8,393,375 because it forms both long sides of the tape as non-adhesive and therefore the adhesive surface area for sealing the case is greatly reduced.

It would be desirable to provide a tape applicator that applies tape to cases in a manner that enables easy peel off but that reduces or eliminates potential issues such as tape pealing during case stacking and/or substantial reduction of the adhesive contact surface on the case.

SUMMARY

An adhesive tape application device does not reduce the sealing power of the adhesive tape on one hand and on the other hand, still provides an easy peel off end of the adhesive tape for case opening. This adhesive tape application device can be used for both as top and bottom case sealing. As a way to illustrate the adhesive tape application device, a bottom adhesive tape application device is described herein.

In one aspect, a method of taping a case involves: moving the case along a case travel path of a case sealing machine; a tape applicator device presenting a free end of a tape supply into the case travel path, wherein the free end includes a non-adhesive end flap portion formed by an end fold over; a leading panel of the case contacts the free end and the portion of the free end adjacent the non-adhesive end flap portion adheres to the leading panel at an initial adhesion point but with the non-adhesive end flap portion not adhered to create a grippable tape removal flap; continued movement of the case causes the tape to be applied from the initial adhesion point toward and onto a flap side of the case and then along the flap side of the case with one side of the tape adhering to an edge of a first flap and another side of the tape adhering to an edge of a second flap; as the flap side of the case clears the tape applicator device tape is applied from the flap side onto a trailing panel of the case; cutting the tape to complete a length of tape being applied to the case and to create a new free end of the tape supply; and automatically folding over the new free end of the tape supply upon itself to form another non-adhesive end flap portion in preparation for a next case taping operation.

In another aspect, a method of taping a case involves: a tape applicator device presenting a free end of a tape supply into a case travel path along which a case moves through a case sealing machine, wherein the free end includes a non-adhesive end flap portion formed by an end fold over; a leading panel of the case contacts the free end and a portion of the free end adjacent the non-adhesive end flap portion adheres to the leading panel but with the non-adhesive end flap portion not adhered to create a grippable tape removal flap; continued movement of the case causes the tape to be applied on the case toward and onto a flap side of the case and then along the flap side of the case with one side of the tape adhering to an edge of a first case flap and another side of the tape adhering to an edge of a second case flap; continued movement of the case causes the tape to be applied from the flap side onto a trailing panel of the case; cutting the tape to complete a length of tape being applied to the case and to create a new free end of the tape supply; and automatically folding over the new free end of the tape supply upon itself to form another non-adhesive end flap portion in preparation for a next case taping operation.

In another aspect, a tape applicator device is provided for use in a case sealing machine in which cases moving along a case travel path are taped along a portion of a leading panel, a flap side adjacent the leading panel and a trailing panel adjacent the flap side. The tape applicator device includes a tape applying roller for holding an adhesive side of tape against the case. A tape fold over mechanism is associated with the tape applying roller and movable from a non-fold over position away from the tape applying roller to a fold over position toward the tape applying roller. A tape travel path extends past the fold over mechanism when the mechanism is in the non-fold over position, and the fold over mechanism moves across the tape travel path when moving from the non-fold over position to the fold over position.

In one aspect, an adhesive tape application device is mounted to a case sealing machine. The adhesive tape application device includes a tape holder, and a base plate which allows a front roller plate to mount on it. At the bottom of the front roller plate, a front roller is mounted, and a non-adhesive tape forming device is also mounted on it. The non-adhesive tape forming device may be composed of a flip bar support basket, and as an ear-shape flip bar weldment. On the flip bar support basket, a magnet retainer, a magnet holder, a spring retaining bar and a backing pad are mounted. The ear-shape flip bar weldment includes a U-shape flip bar and a spring holding bar. The front roller plate is linked with the back roller plate by a rod and lets the front and back roller work simultaneously. On the base plate several holes are set to let the base plate connect with the front plate. The front plate has two holes which allow the adjustable knife mounting plate to mount on it. The front plate has another set of holes to enable the static roller mounting plate to connect with it.

The details of one or more embodiments are set forth in the accompanying drawings and the description below. Other features, objects, and advantages will be apparent from the description and drawings, and from the claims.

BRIEF DESCRIPTION OF THE DRAWINGS

FIGS. 12-22 are a sequence of illustrations that how the non-adhesive tape forming device applies forms the non-adhesive tape end during tape application to a case; and FIGS. 12A-22A show enlarged portions if FIGS. 12-22 respectively.

DETAILED DESCRIPTION

Figure 1:
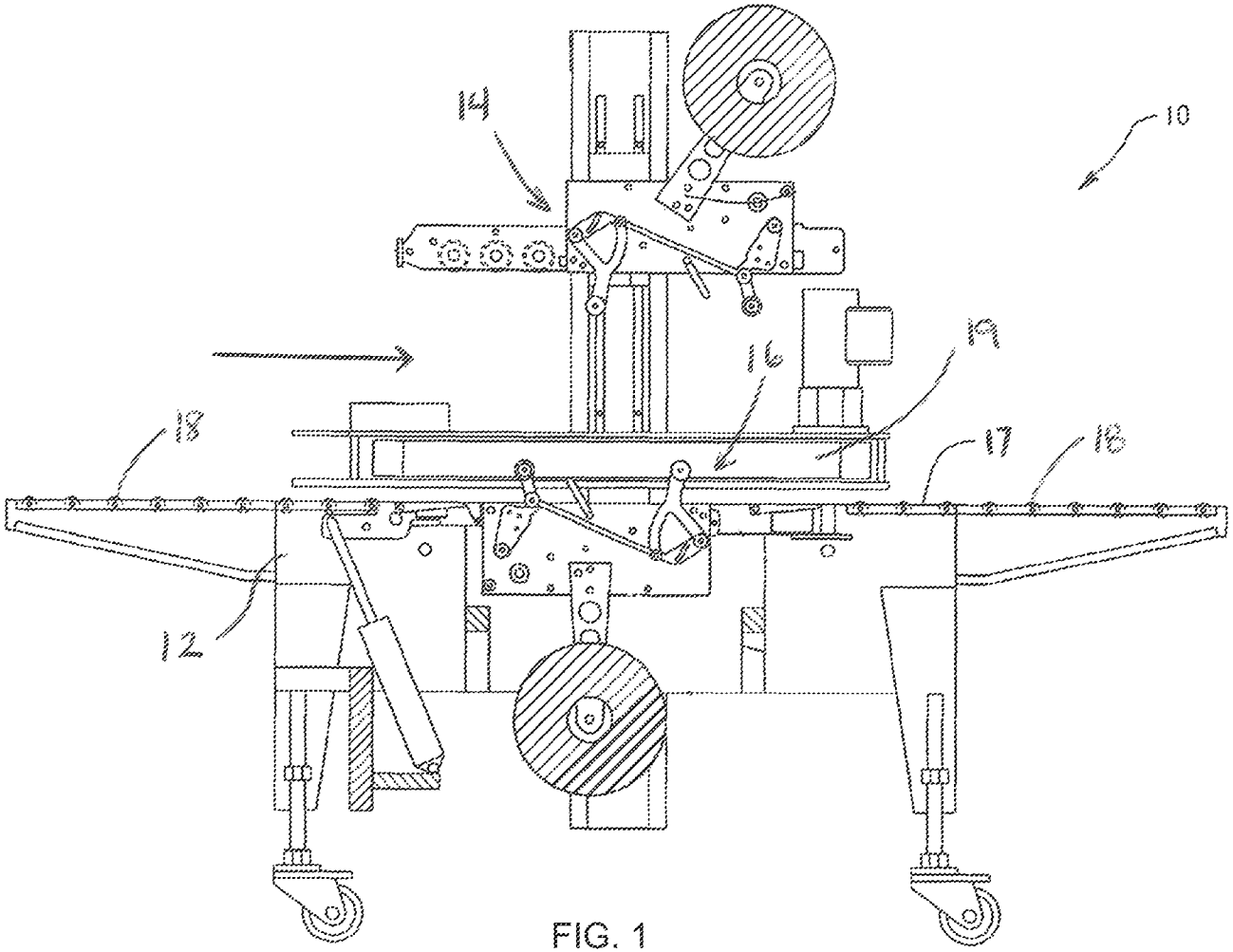
FIG. 1 shows a side elevation of one embodiment of a case sealing machine.

Referring to FIG. 1, an exemplary case sealing machine 10 is shown, which machine may accommodate cases of various sizes. The case sealing apparatus 10 includes a frame 12 with a conveyor bed 17. In the illustrated embodiment, the conveyor bed 17 includes a series of horizontally aligned rollers 18, however, other conveyor elements can be used such as balls, or even a low friction, flat surface material. Laterally spaced apart drive belts 19 are provided to drive cases through the machine (e.g., in the left to right direction of the illustrated arrow) as the cases sit atop the conveyor bed with one flap side facing up and the other flap side facing down, but other forms of conveying mechanisms could be used. As the case is moved through the machine, upper and lower tape applicator devices 14 and 16 apply tape to the seal the flap sides of the case. The exact configuration of the overall machine, including whether it includes both an upper and lower tape applicator as shown, or whether it includes just an upper tape applicator or just a lower tape applicator, can vary.

Figure 2:
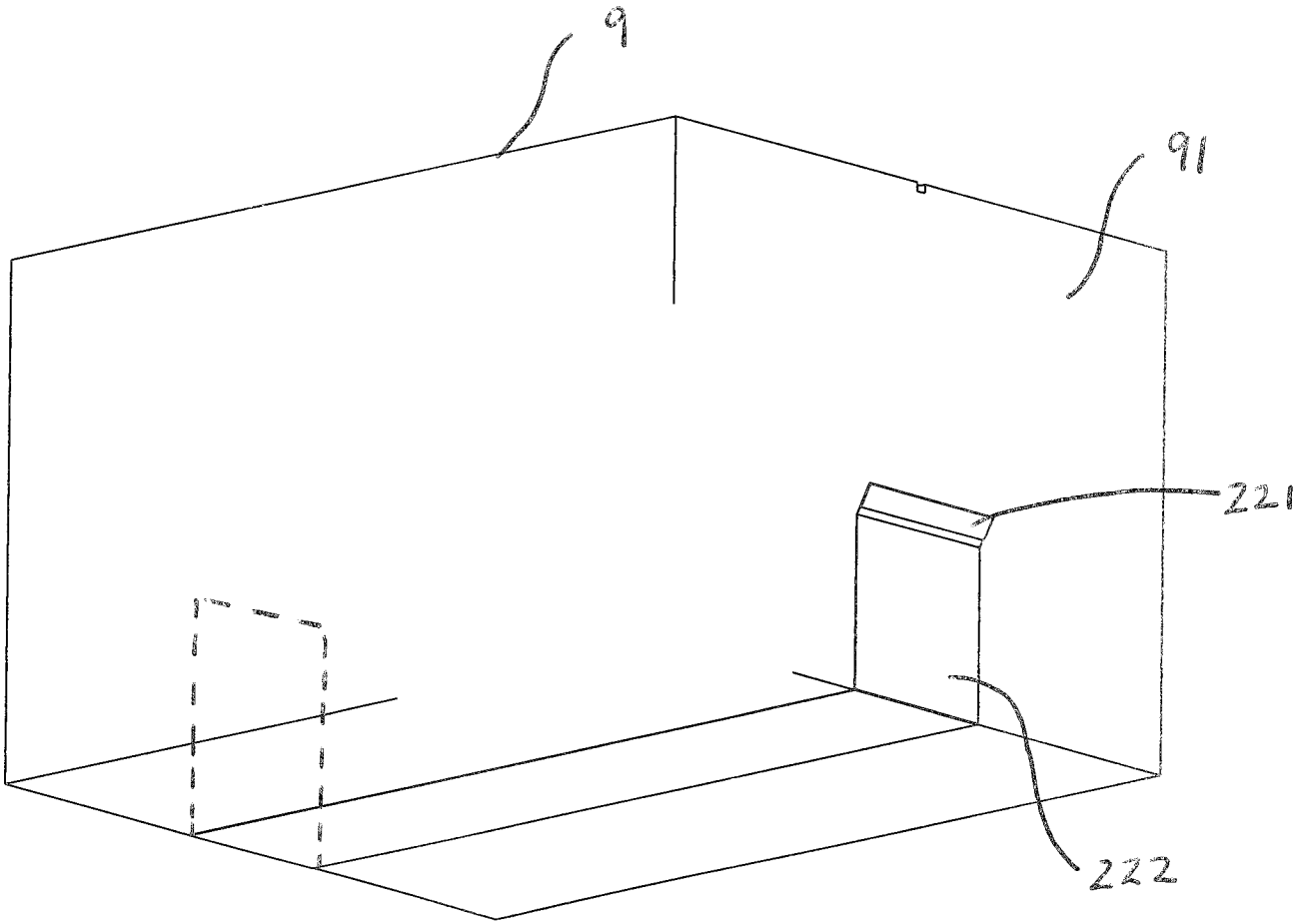
FIG. 2 shows a perspective view of a case with taped bottom flap side.

Referring to FIG. 2, an exemplary case 9 sealed along the bottom flap side sealed by adhesive tape 222 is shown. Case panel 91 represents a leading case panel of the case 9 (e.g., the panel that moved through the case sealing machine first), with the adhesive tape 22 adhered to and extending upward on the trailing panel 93 (per the dashed line form), extending along the bottom flap side of the case and then extending partly upward along the leading panel 91 and terminating in a folded tape end 221 that provides a non-adhesive and grippable tape removal flap on the leading panel. Notably, in such an arrangement all adhesive tape on the case other than end flap 221 may be adhesive, without any type of foldovers that might reduce adhesion. The adhesive tape application device described below with reference to FIGS. 3-22 can be used in the case sealing machine 10 (or other configurations of case sealing machines) to achieve such a sealed case.

Figure 3:
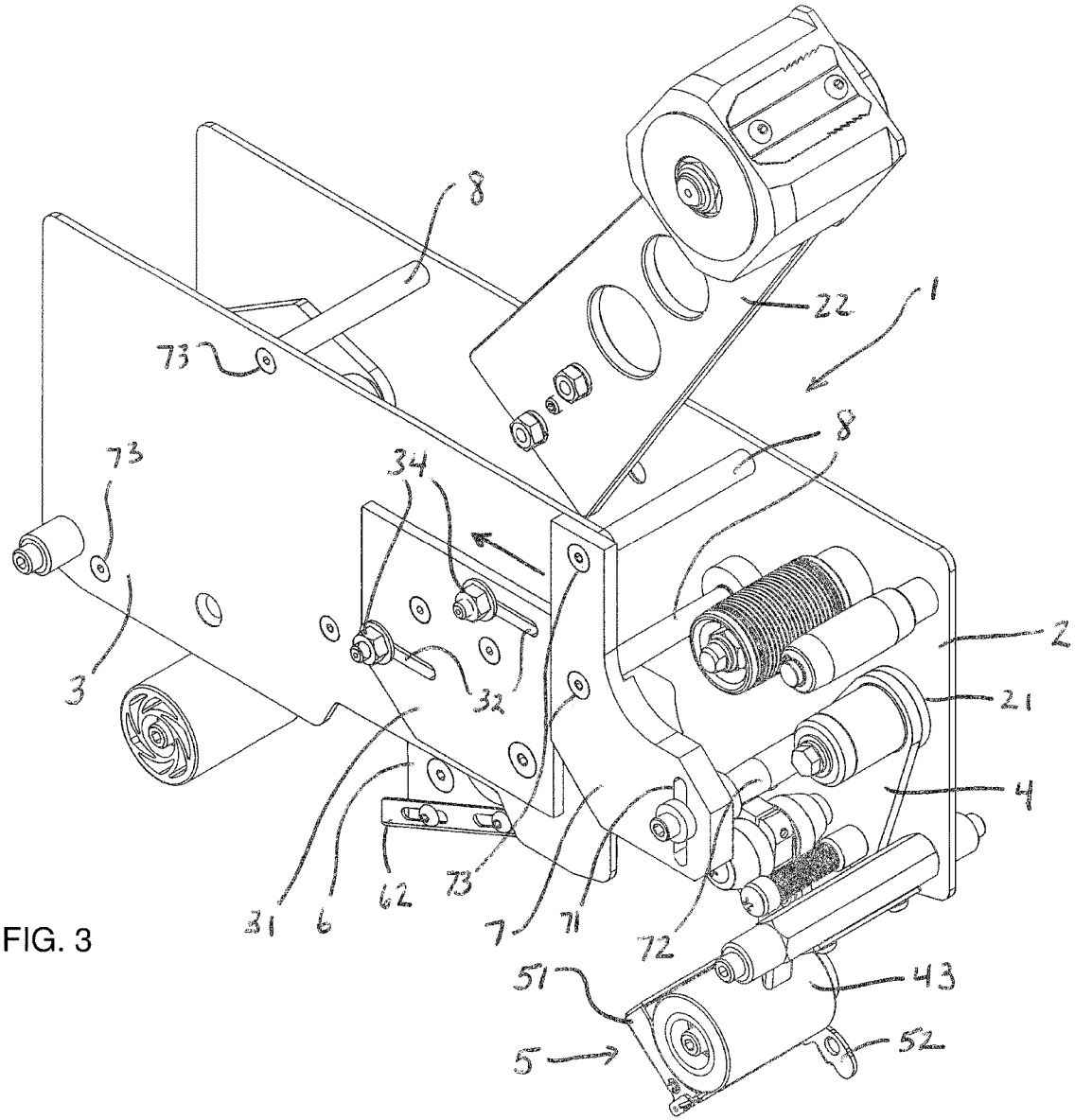
FIG. 3 is a perspective view of one embodiment of an adhesive tape application device.

FIG. 3 shows a perspective view of the adhesive tape application device 1. The adhesive tape application device 1 includes a base plate 2 spaced apart from a front plate 3. At the front part of the base plate 2 a hole 21 allows a tape controlling rod 41, which passes through another hole 42 (not shown in FIG. 3, but see FIG. 7) in a front roller plate 4, to connect with base plate 2. At the bottom of the front roller plate 4 is a front roller 43, and below the front roller 43, the non-adhesive tape forming device 5 is mounted on the front roller plate 4. The non-adhesive tape forming device 5 includes a flip bar support bracket or basket 51, and an ear-shape flip bar weldment 52. At the top of the base plate 2, a tape holder 22 is mounted. At the opposite side of the base plate 2 is the front plate 3, which is connected with the base plate 2 by connecting rods 8. An adjustable knife mounting plate 31 is mounted on the front plate 3 by two threaded fastener assemblies 34 engaged in respective parallel elongate shaped openings 32 of the front plate 3. When the fasteners 34 are loosened, the adjustable knife mounting plate 31 can move within two rectangular windows 33 (not shown in FIG. 3, but see FIG. 9) located on the front plate 3. When the desired position of the mounting plate 31 is achieved, the fastener arrangements 34 are again tightened to hold the mounting plate 31 in position for operation. This adjustable movement permits adjustment of a distance of a knife cutting plate 6 by moving forward or backward so as to adjust the distance between the knife 61 (not shown in FIG. 1, but see FIG. 5) and the front roller 43. If the adjustable knife mounting plate 31 moves far enough backward (indicated by the arrow) and the screws 34 reach the end point 35, then the knife cutting plate 6 is spaced away from the front roller 43 when cutting the tape, and the length of the non-adhesive folded up end 221 of the tape (not shown in FIG. 3, but see FIG. 2) will achieve its longest possible dimension. On the contrary, the non-adhesive tape folded up front end will achieve its shortest possible dimension when the mounting plate 31 is secured in the position of FIG. 3. By way of forward and backward movement of the adjustable knife mounting plate 31, a user can control the length of the non-adhesive tape front portion that is formed during tape application to any length between the longest possible dimension and the shortest possible dimension.

A case sensing basket 62 is mounted on the knife cutting plate 6. At the front end of the front plate 3, an L-shape static roller mounting plate 7 is connected through holes 73 with the base plate 2 by two connecting rods 8 and holes 81 (not shown in FIG. 3, but see FIG. 5). At the lower end of the L-shape static roller mounting plate 7 is a vertical elongated shape opening 71 which allows a tape tension roller 72 to move upward and downward to adjust the tension of the tape in order to adjust the length of the tape that stays on the front roller 43 after cutting.

Figure 4:
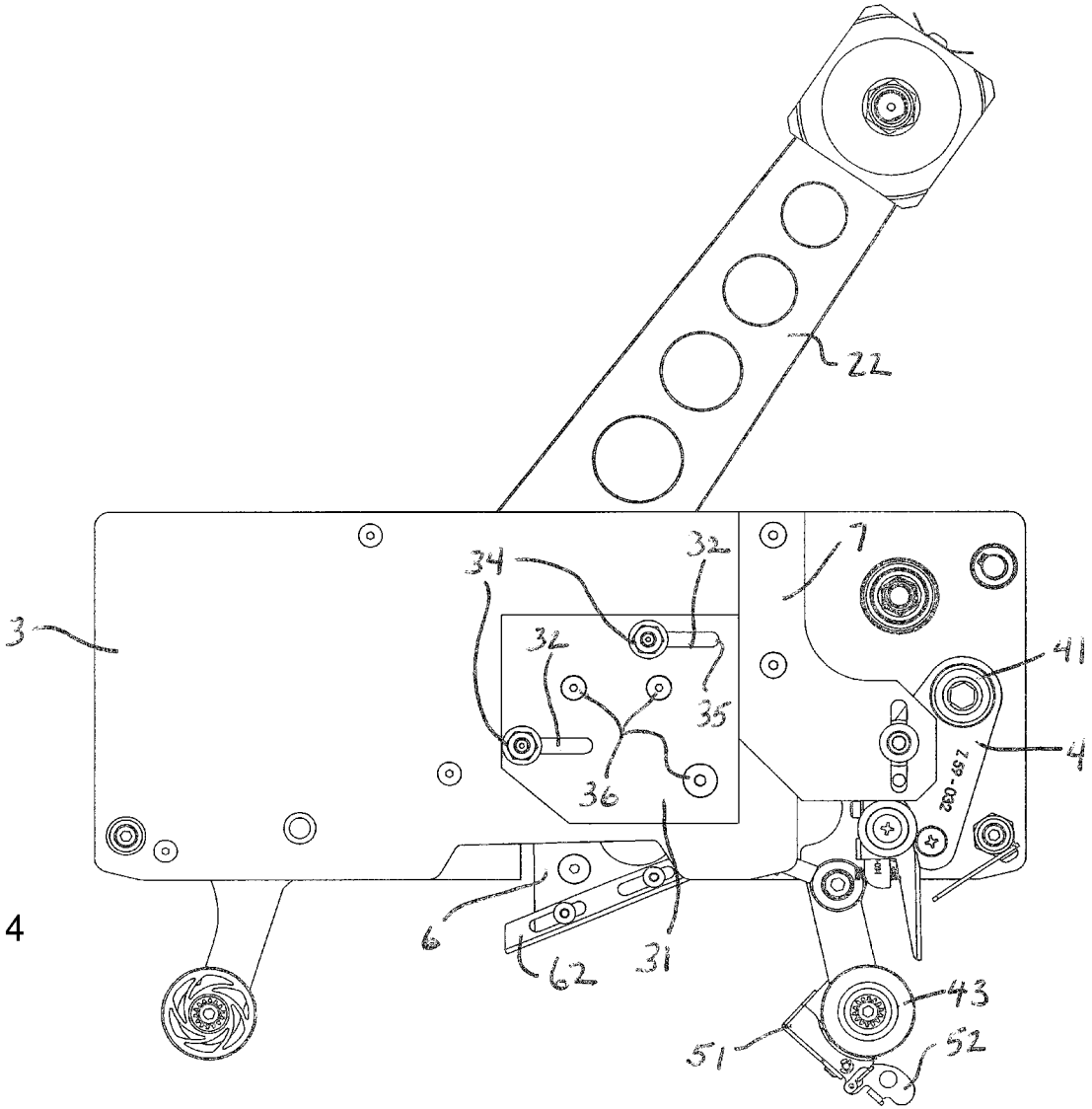
FIG. 4 is a front side view of the device of FIG. 1.

FIG. 4 is a side view of front plate 3, showing the adjustable knife mounting plate 31 mounted by the screws or fastener arrangements 34 in slots 32. The adjustable knife mounting plate 31 has three holes 36 which are used to mount the knife holding plate 6 on the adjustable knife mounting plate 31. The backward and forward movement of the adjustable knife mounting plate 31 toward or away from the slot end point 35 in the two parallel long oval shape openings 32 can control the length of the non-adhesive front tape end as described above.

Figure 5:
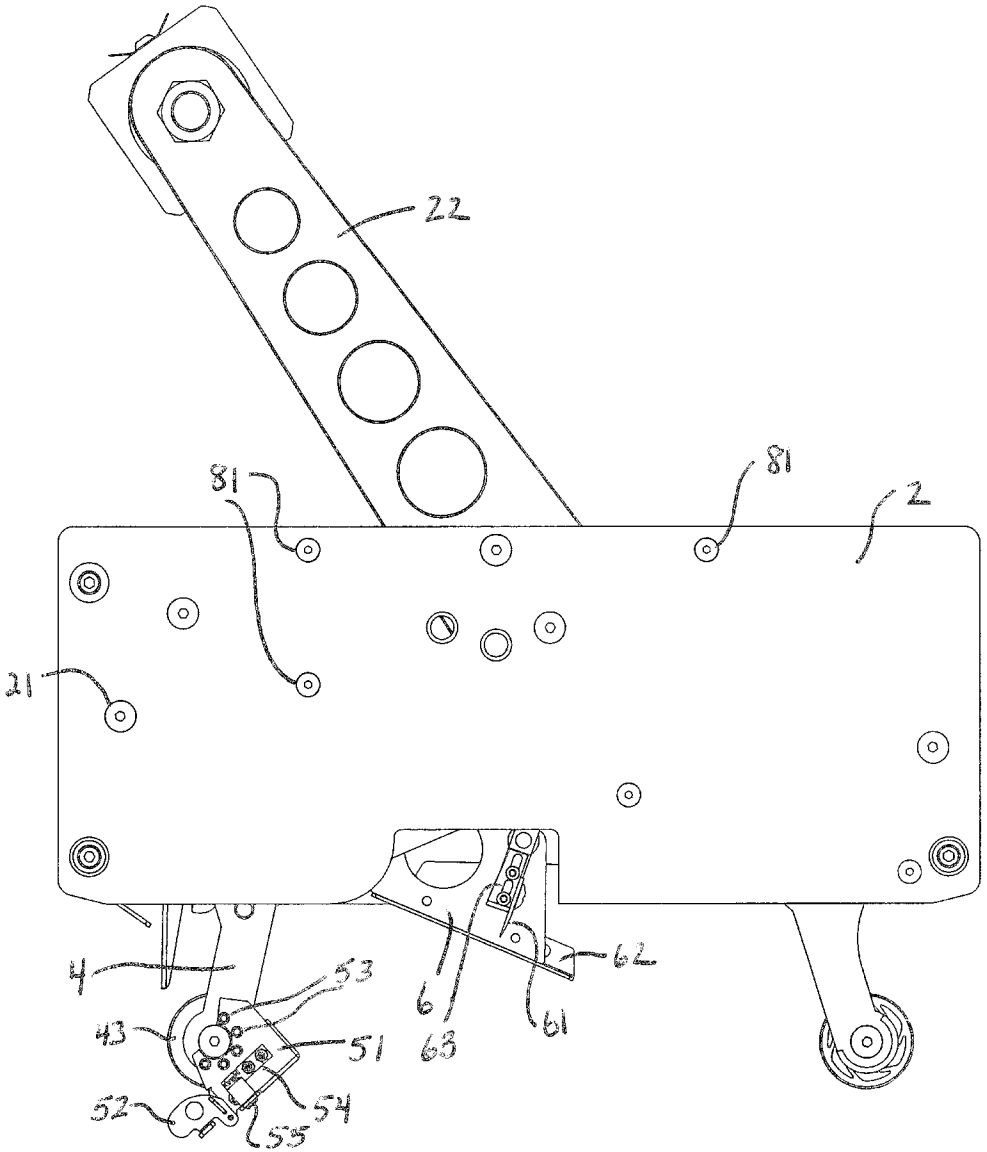
FIGS. 5 and 6 are front and back side views of the device of FIG. 1 with front plate removed.
Figure 6A:
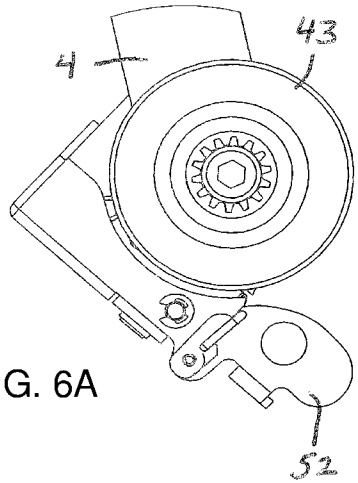
FIG. 6A shows an enlarged portion of FIG. 6.
Figure 6:
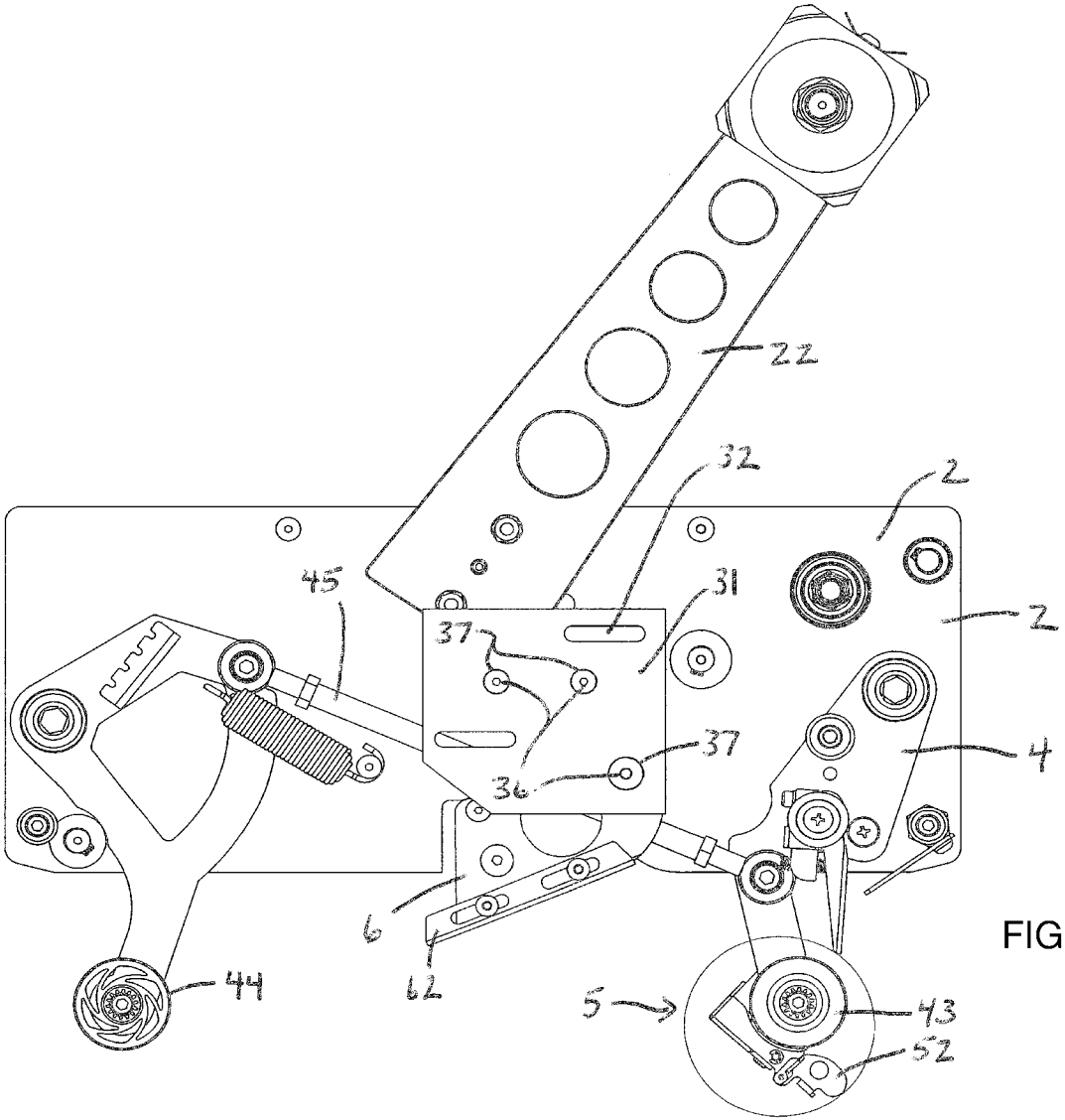

Per FIGS. 5-6, the tape holder 22 is mounted at the top of the base plate 2. Holes 81 located on the base plate 2 are used to connect the front plate 3 via the connecting rods 8 mentioned above. The non-adhesive tape forming device 5 is mounted at the bottom of the front roller plate 4 and includes the flip bar support basket 51 which has several holes 53 on it that are used for threaded fasteners to connect the flip bar support basket 51 with the front roller plate 4. A magnet retainer 54 is mounted on the flip bar support basket 51, along with a magnet holder 55 below the magnet retainer 54. The magnet holder 55 contains a magnet 551 (FIGS. 7 and 8A) and a spring 552 which are used to engage with the ear-shape flip bar weldment 52. When the flip bar support basket 51 and the ear-shape flip bar weldment 52 are forced to engage, the spring 552 can absorb the contact force. The flip bar support basket 51 is connected at its lower end with the ear-shape flip bar weldment 52 through the hole 522. At the other side of knife cutting plate 6, the knife 61 is mounted on the knife mounting block 63, which is mounted on the knife cutting plate 6. Per FIG. 6, the back roller 44 is connected with the front roller plate 4 by a rod 45 and it makes the front roller 43 and back roller 44 reacted simultaneously.

Figure 7:
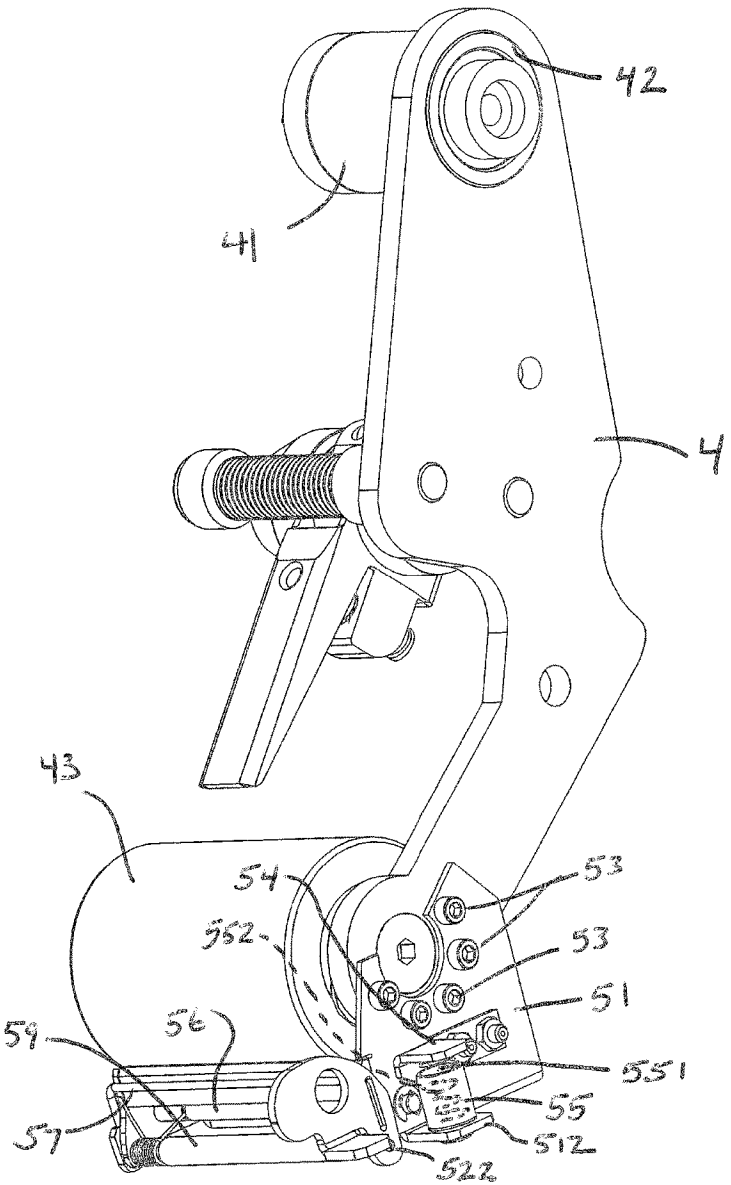
FIG. 7 is a perspective view of the front roller plate of the device of FIG. 1.

FIG. 7 shows a perspective view of the front roller plate 4. At the top of the front roller plate 4, tape controlling rod 41 passes through the hole 42 and connects with the base plate 2 (not shown). At the bottom of the front roller plate 4, the front roller 43 is mounted. The flip bar support basket 51 includes several holes 53 that are used to connect the flip bar support basket 51 with the front roller plate 4. The flip bar support basket 51 has a magnet retainer 54 mounted on it, located above the magnet holder 55 to keep the magnet 551 and spring 552 inside the magnet holder 55, which is mounted on plate 512. The ear-shape flip bar weldment 52 is mounted on the side of the flip bar support basket 51. The ear-shape flip bar weldment 52 includes a U-shape flip bar 57, and a spring holding bar 59.

Figure 8A:
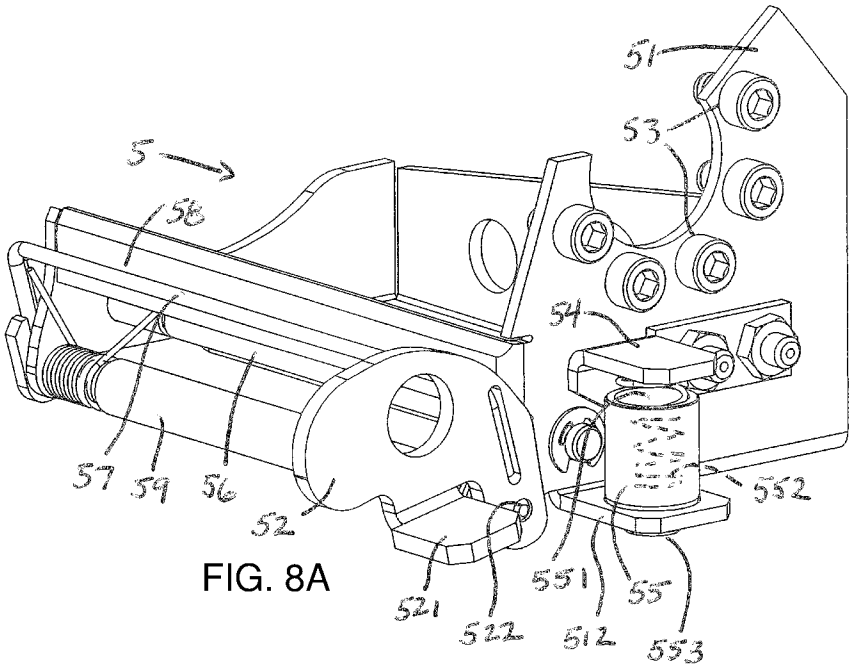
FIG. 8A is an exploded view of the non-adhesive tape forming device of the device of FIG. 1.
Figure 8B:
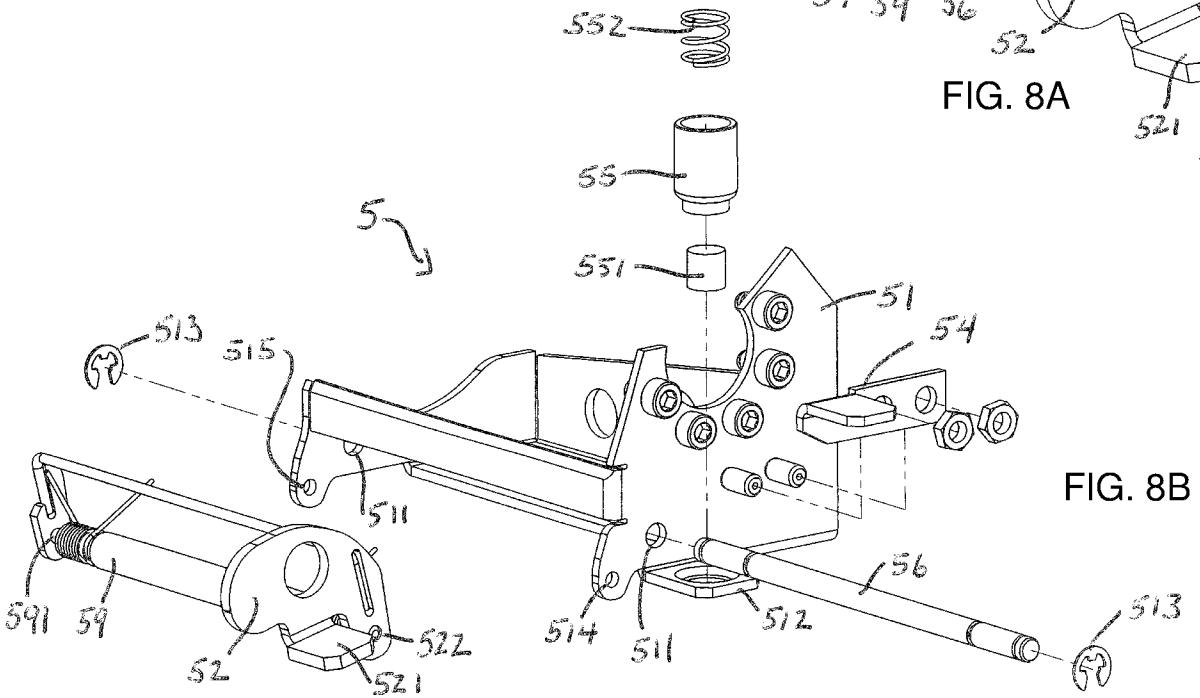
FIG. 8B is an assembled view of the device of FIG. 8A.

Referring to the FIGS. 8A and 8B, the non-adhesive tape end forming device 5 includes the ear-shape flip bar weldment 52 and the flip bar support basket 51. The U-shape flip bar 57 and a spring holding bar 59 are mounted on the ear-shape flip bar weldment 52, with hole 522 used to connect with the flip bar support basket 51 by the corresponding hole 514 on the support basket 51. The front small rod head 591 of the spring holding bar 59 will be entered into the hole 515 of the flip bar support basket 51 so as to connect the flip bar support basket 51 with the ear-shape flip bar weldment 52. At the bottom of the ear-shape flip bar weldment 52, a square metal plate 521 is mounted and used to releasable hold to the magnet 551 that is held inside the magnet holder 55. Holes 53 are used to mount the flip bar support basket 51 on the front roller plate 4 (not shown), and the magnet retainer 54 is mounted on the same side of the basket 51. S square plate 512 includes a hole in the centre, to allow the magnet holder 55 to sit inside and the surface 553 of the magnet 551 will contact with the square metal plate 521 and hold together by magnetic force. A spring retaining bar 56 is mounted on flip bar support basket 51 by passing through the holes 511 and is fixed by the snap-rings rings 513. The working of the spring retaining bar 56 and the spring holding bar 59 will maintain the force for the bounce back of the ear-shape flip bar weldment 52 to its relaxing condition after the tape applying cycle is completed. At the front end of the flip bar support basket 51, a backing pad 58 is mounted to avoid the over bouncing back of the U-shape flip bar 57 when the ear-shape flip bar weldment 52 is released back to is normal, relaxed position.

Figure 9:
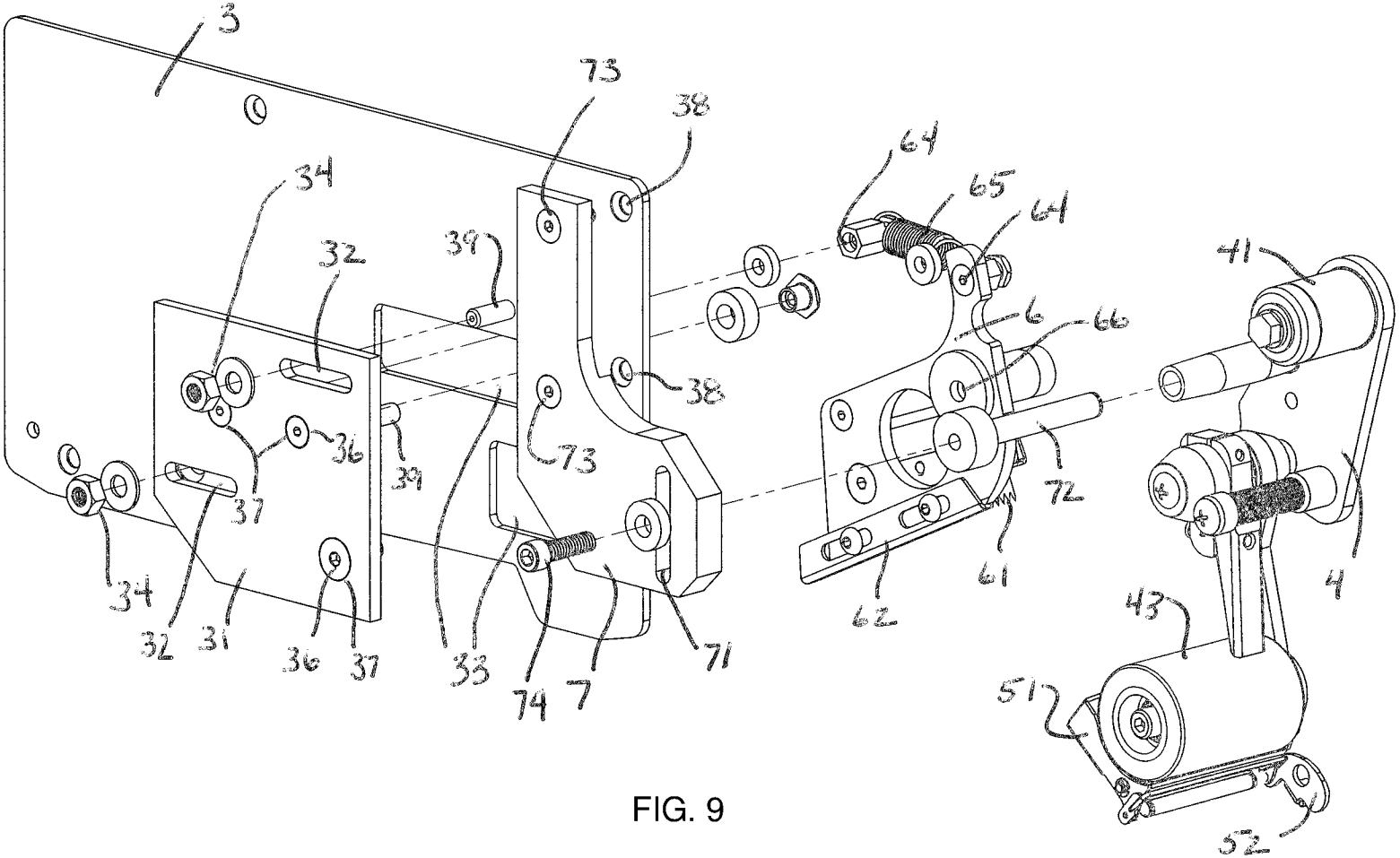
FIG. 9 is a partial exploded view of the device of FIG. 1 including front plate.

Per FIG. 9, the front plate 3 has two rectangular windows 33 which are used for connecting the knife cutting plate 6 with the adjustable knife mounting plate 31 by the threaded fasteners 36. The adjustable knife mounting plate 31 has three holes 37 for the fasteners 36 to pass through, and the fasteners then extend through the respective rectangular windows 33 to screw into the holes 64. A spring 65 is linked with the holes 64 and is also linked with the top of the knife cutting plate 6. At the lower rectangular window 33, a fasteners 36 passes through the hole 37 of the adjustable knife mounting plate 31 and connects with the hole 66 located on the knife cutting plate 6. All these three fasteners 36 mount the knife cutting plate 6 with the adjustable knife mounting plate 31 and allow the knife cutting plate 6 to move within the rectangular windows 33 in order to react to the forward and backward movement of the adjustable knife mounting plate 31 and accomplish the task of adjusting the length of the non-adhesive tape portion as mentioned above.

On the front plate 3 two threaded fasteners 39 extend from the front plate 3 and are used to pass through the two parallel long oval shape opening 32 of the adjustable knife mounting plate 31 and connect with the bolts that complete the fastener arrangements 34. At the front side of the front plate 3, there are two holes 38 which allow the fasteners 73 to pass through and mount the L-shape static roller mounting plate 7 with the front plate 3 and finally connect with the base plate 2 by two connecting rods 8 (shown in FIG. 3).

On the L-shape static roller mounting plate 7, there is a vertical elongate shape opening 71 which allows a threaded fastener 74 to pass through and screw into the tape tension roller 72. The tape tension roller 72 moves upward and downward to adjust the tension of the tape in order to adjust the length of the tape that stays on the front roller 43 after cutting.

Figure 10:
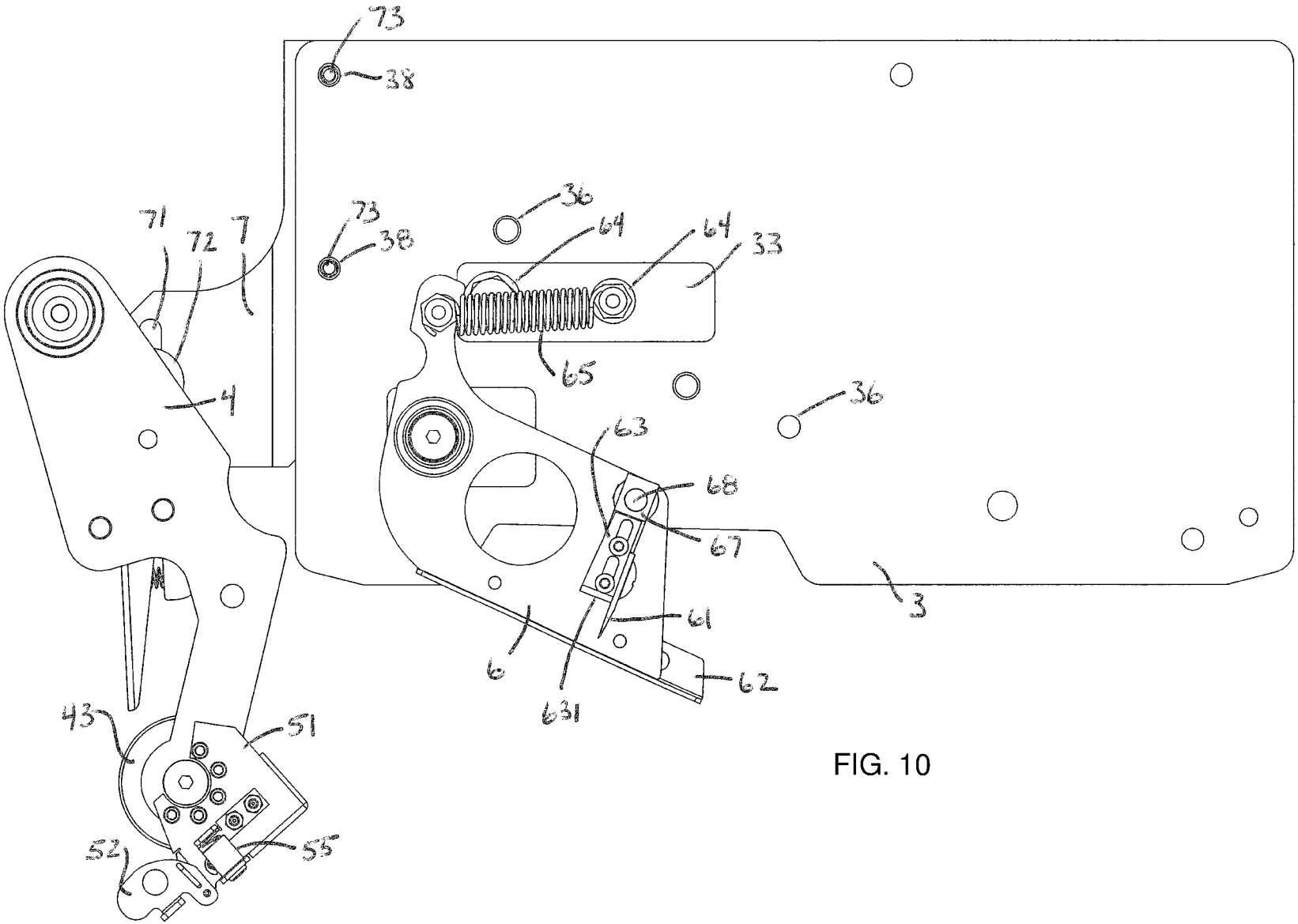
FIGS. 10 and 11 are views of the front plate with components mounted thereto.
Figure 11:
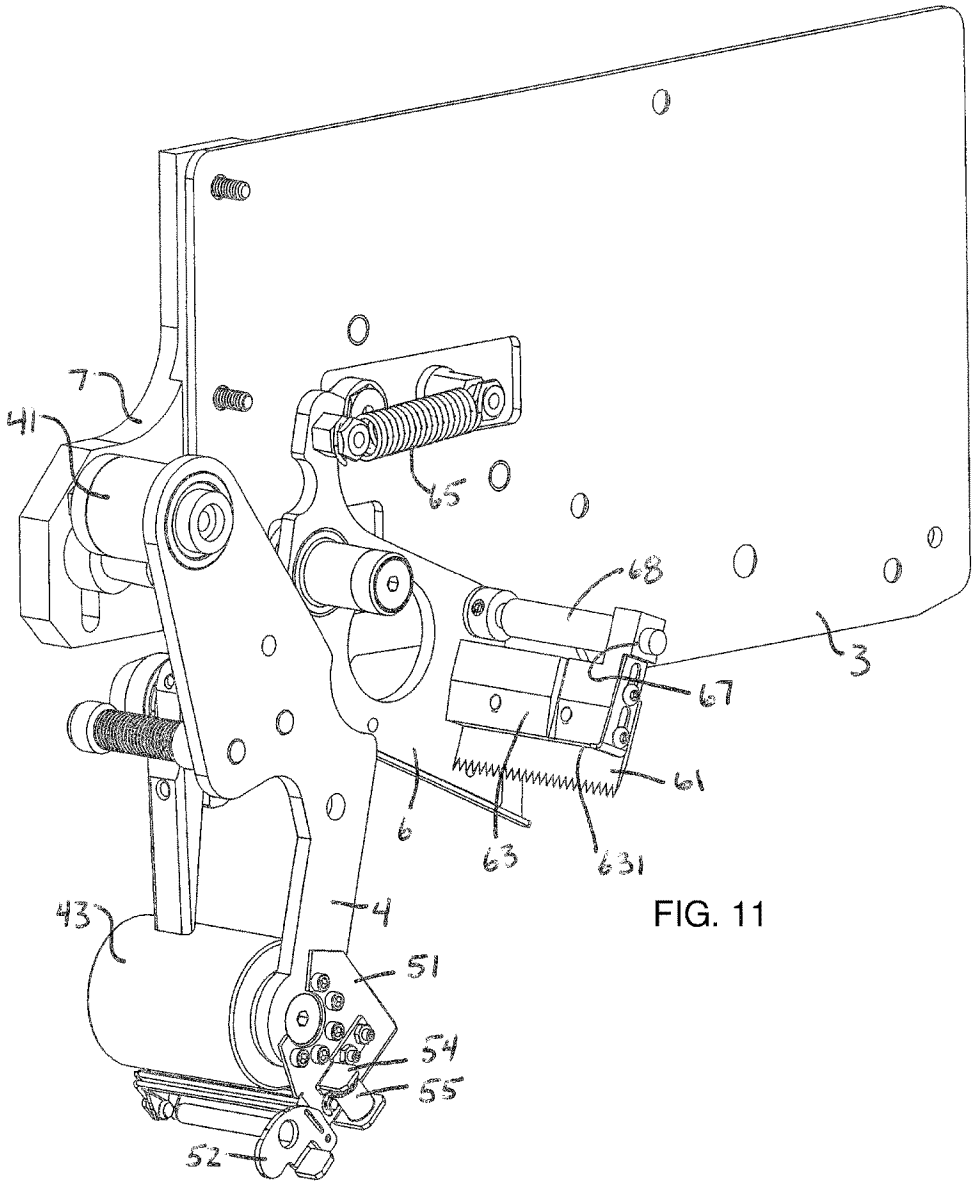

FIGS. 10 and 11 indicate how the knife cutting plate 6 and the L-shape static roller mounting plate 7 are mounted on the front plate 3 and the position of the front roller plate 4. The knife cutting plate 6 shows the knife 61 is mounted on the knife mounting block 63 and knife mounting block 63 has hole 67 for the rod 68 to pass through and connect the knife mounting block 63 with the knife cutting plate 6. At the opposite side of the knife cutting plate 6, the case sensing basket 62 is mounted. In FIG. 11 the knife 61 is mounted on the knife mounting block 63 with the sharp knife blade extended from the knife mounting block 63. The purpose of mounting the knife 61 in this way is, when the knife 61 is pressed to cut the tape, the front end 631 of the knife mounting block 63 will knock against the ear-shape flip bar weldment 52 and separate the flip bar support basket 51 and the ear-shape flip bar weldment 52 from the condition that they are held or latched together by the magnetic force of the magnet 551. As a result, the ear-shape flip bar weldment 52 will bounce back to its relaxing condition because the spring retaining bar 56 and the spring holding bar 59 maintains a bounce back force on the ear-shape flip bar weldment 52. When the ear-shape flip bar weldment 52 bounces back, the U-shape flip bar 57 will fold up the front end of the adhesive tape to form a non-adhesive tape front end portion at the same time of bouncing back. Then the U-shape flip bar 57 of the non-adhesive tape forming device 5 will keep holding the non-adhesive tape front end portion and prevent the adhesive tape from dropping down or moving to an improper sealing position because of gravity or thinner tape quality. The non-adhesive tape forming device 5 is then ready for the next fold up of the tape end process.

FIGS. 12-22 depict the operation of the formation of the non-adhesive tape front end portion during movement of case 9. Each of the figures contains a circled part which is enlarged to provide clear illustration of how the flip bar support basket 51 and ear-shape flip bar weldment 52 work together to form the non-adhesive tape front portion. In FIGS. 12-21 plate 22 is not shown for the purpose of viewing of the operation of the assembly.

Figures 12, 12A:
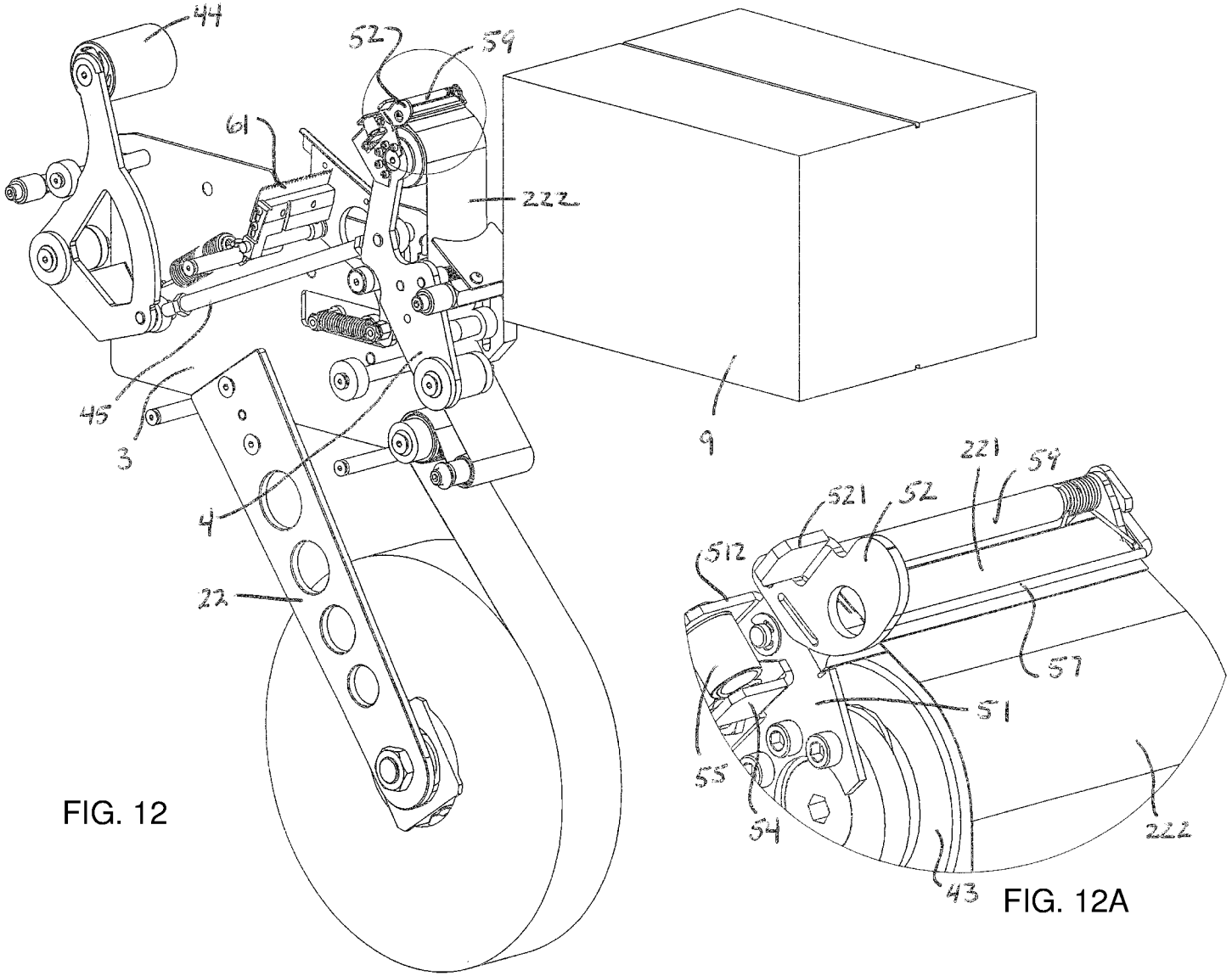

In FIGS. 12 and 12A, the ear-shape flip bar weldment 52 is biased into its normal position. The ear-shape flip bar weldment 52 is not stuck against the flip bar support basket 51. The adhesive tape 222 already has a non-adhesive tape front or end portion 221 held by the U-shape flip bar 57, which was formed by the bounce back action of the ear-shape flip bar weldment 52 of the last tape applying cycle.

Figures 13, 13A:
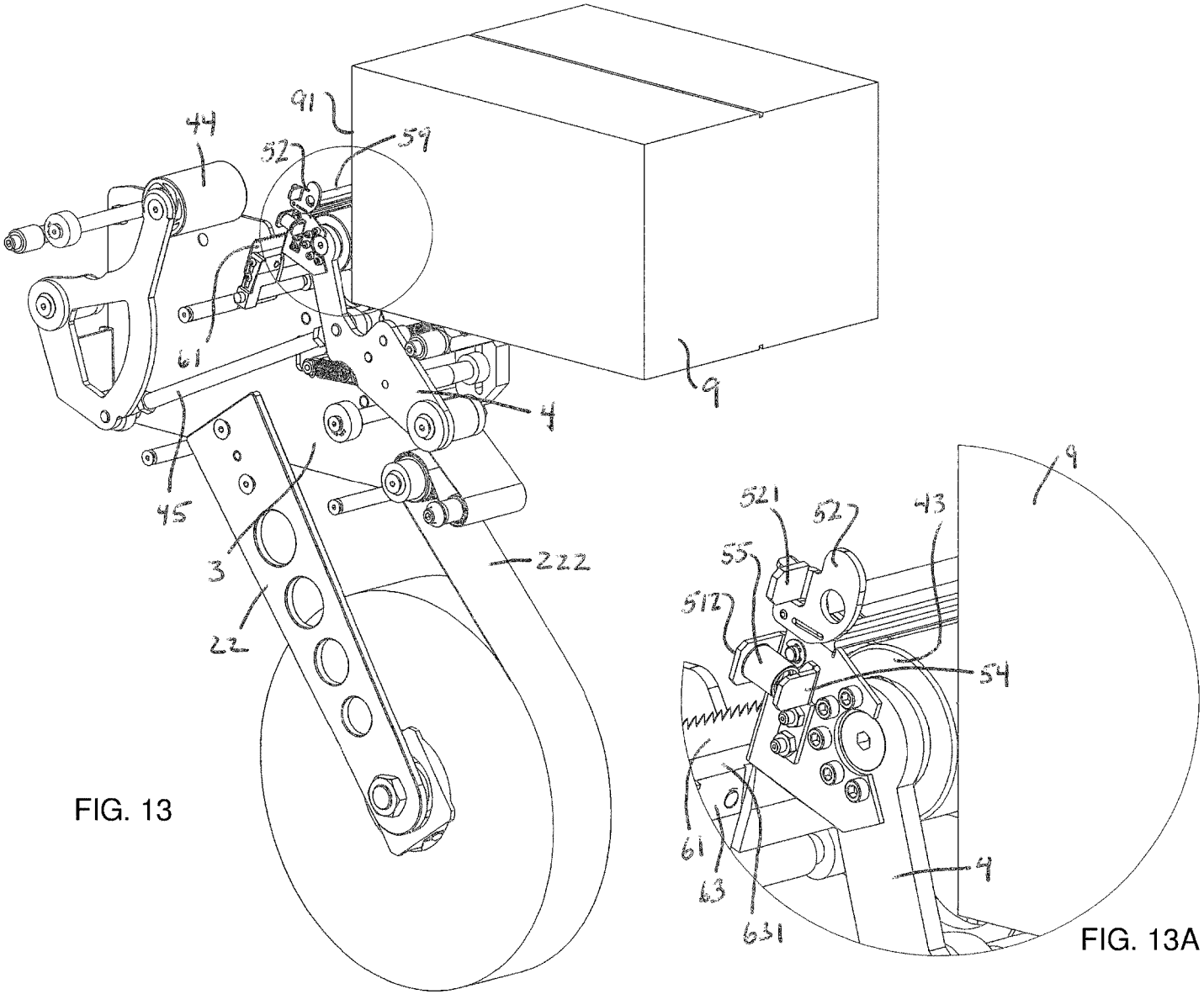

In FIGS. 13 and 13A, when the case 9 moves towards the front roller 43 the roller plate 4 begins to pivot, and the portion of the adhesive tape 222 that is connected with non-adhesive front portion and that has its adhesive side facing the case will stick on the front blank or leading panel 91 of the case 9.

Figures 14, 14A:
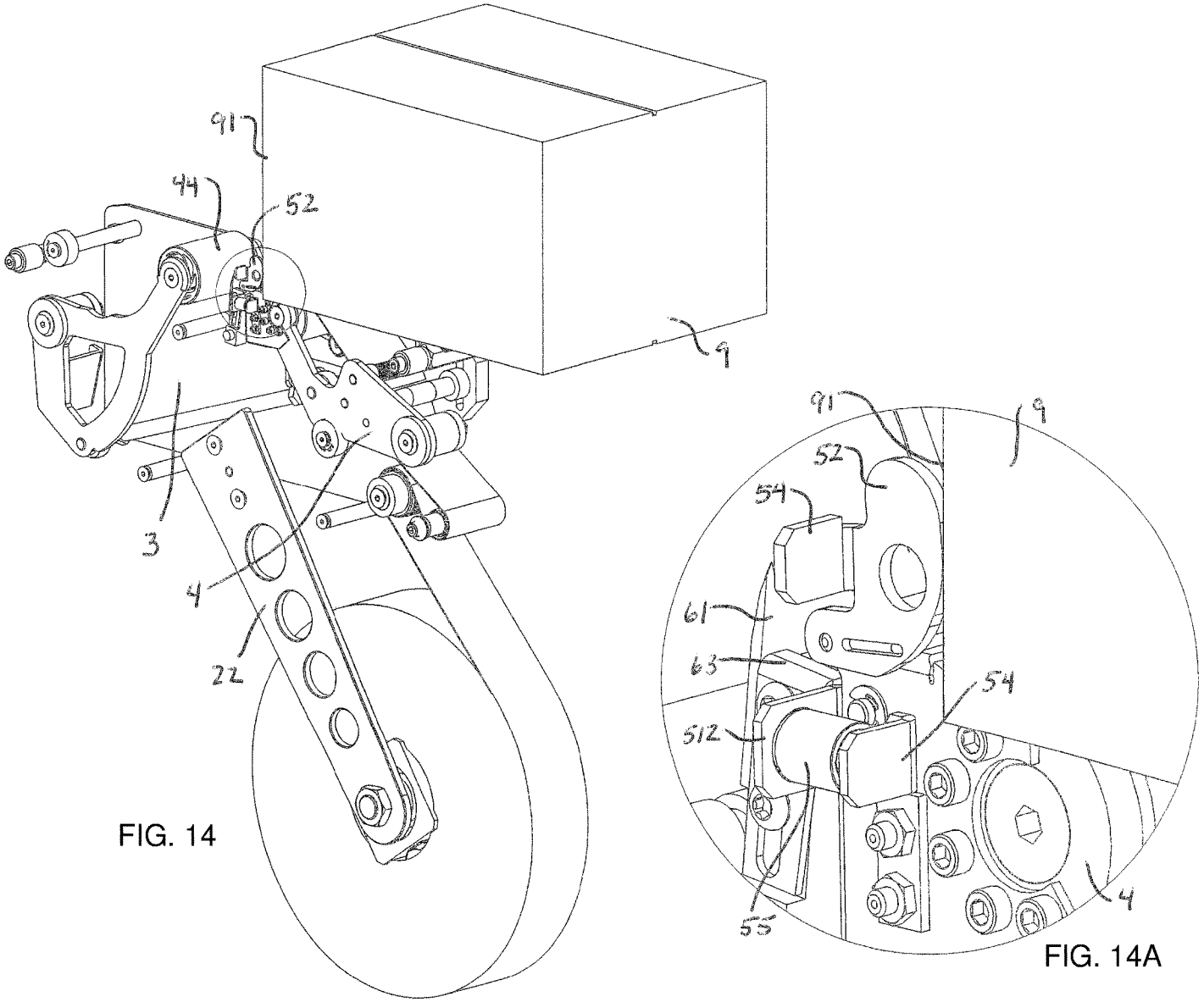

In FIGS. 14 and 14A, as the case 9 continues its movement it causes the roller plate 4 to pivot further and the front blank or leading panel 91 of the case 9 knocks against the ear-shape flip bar weldment 52.

Figure 15A:
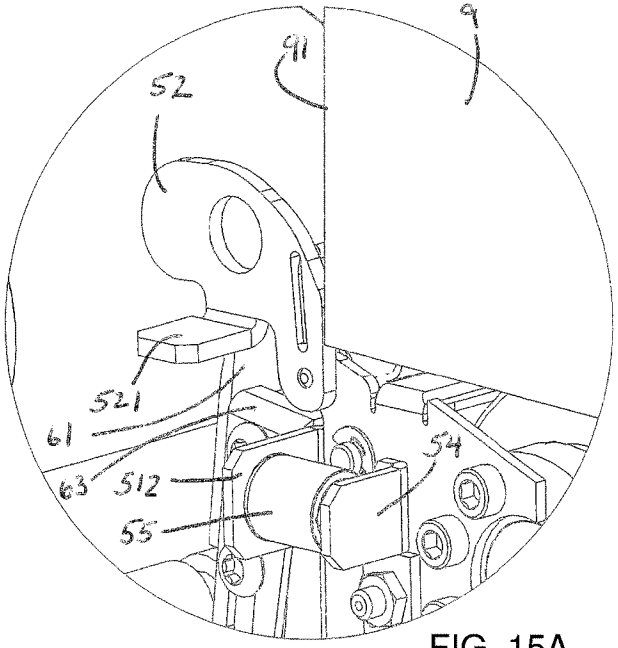
Figure 15:
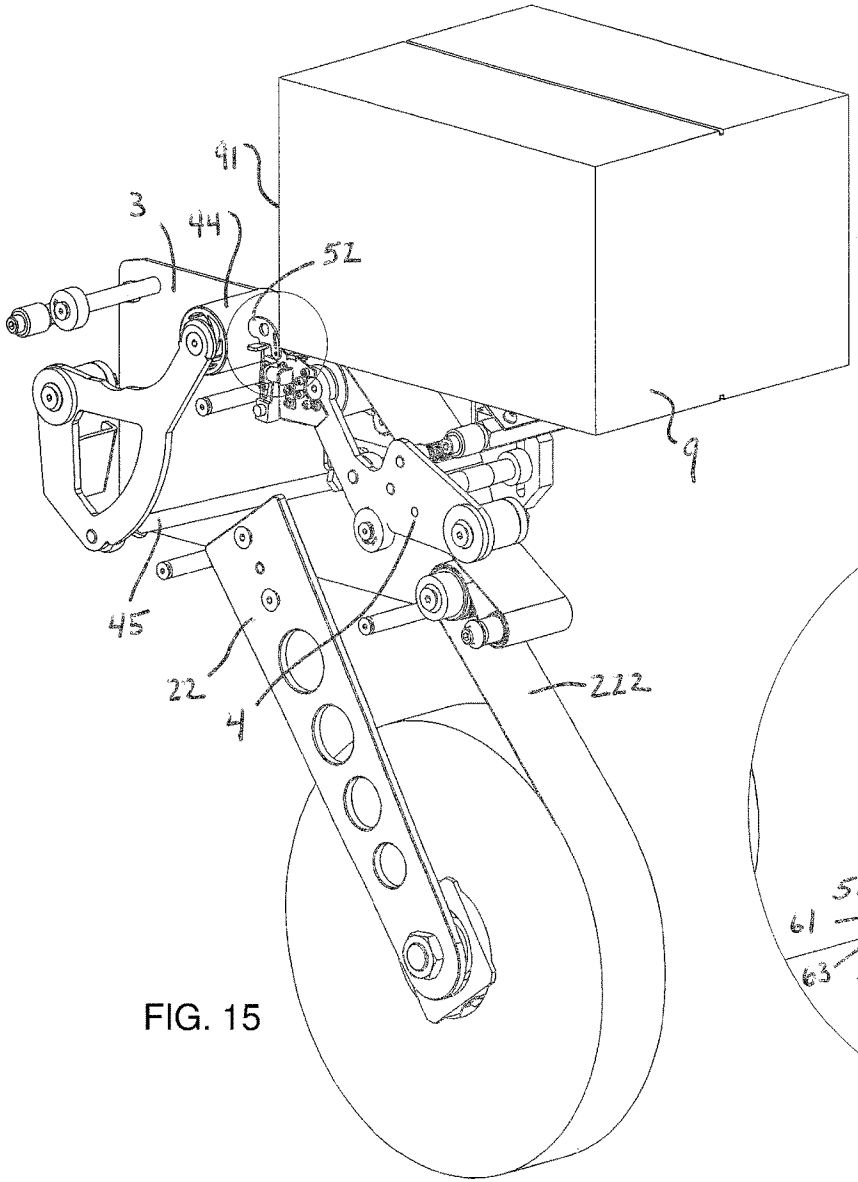
Figure 16A:
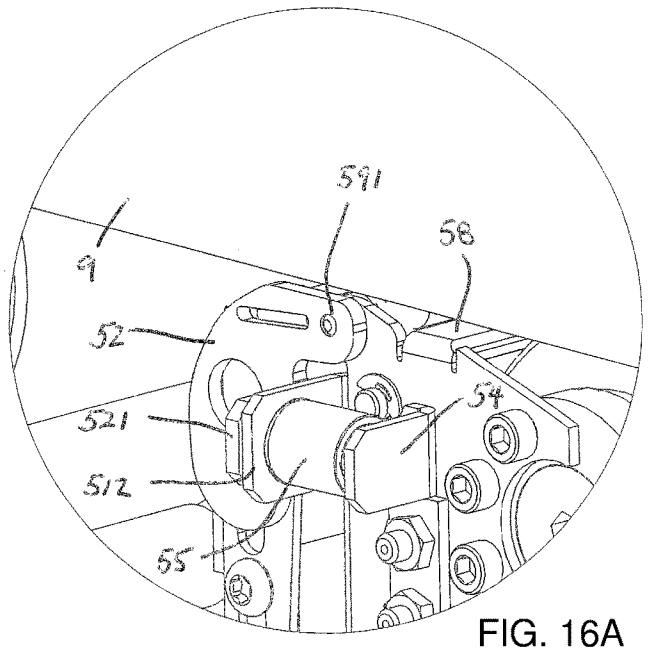
Figure 16:
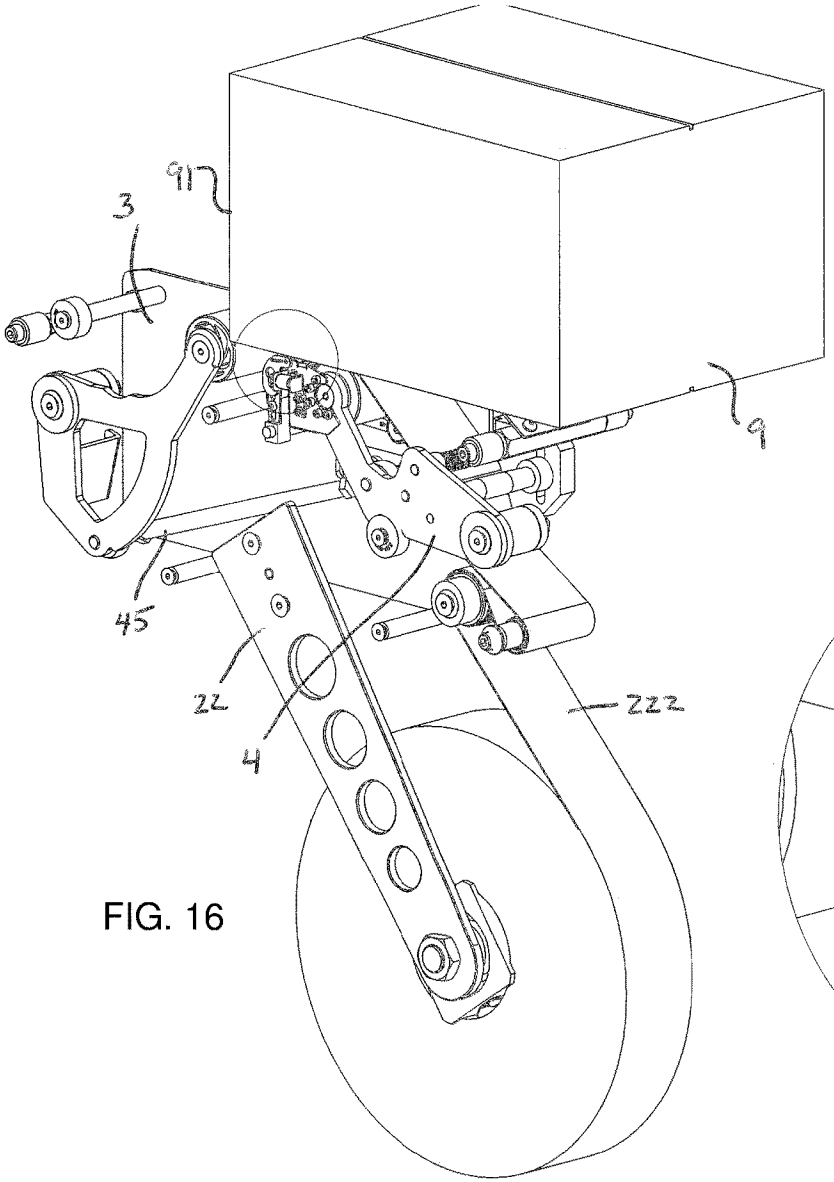

In FIGS. 15 and 15A, continued progression of the case causes the front blank 91 to push against the ear-shape flip bar weldment 52, causing rotation of the flip bar weldment. As illustrated in FIGS. 16 and 16A, the front blank 91 of the case 9 completely knocks down the ear-shape flip bar weldment 52, at which point the square metal plate 521 of the ear-shape flip bar weldment 52 is pushed towards the square plate 512 and is then retained in that position by magnetic attraction to the magnet (which may include engaging the surface of the magnet 551). At this time the non-adhesive front tape is already held on the front blank 91 of the case 9 by the immediately adjacent adhesive portion of the tape that has been engaged on the front blank or leading panel 91. The case continues to move over the top of the flip bar weldment as tape is rolled onto the bottom flap side of the case and adhered to the edges of the flaps across the seam between the flaps.

Figure 17A:
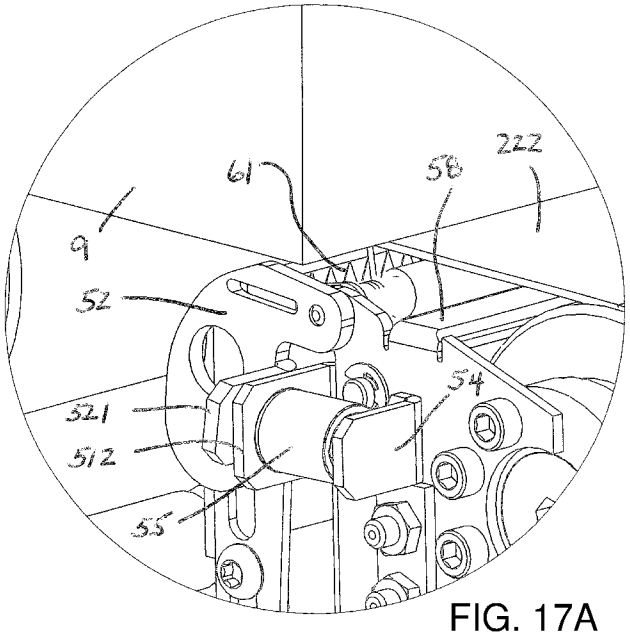
Figure 17:
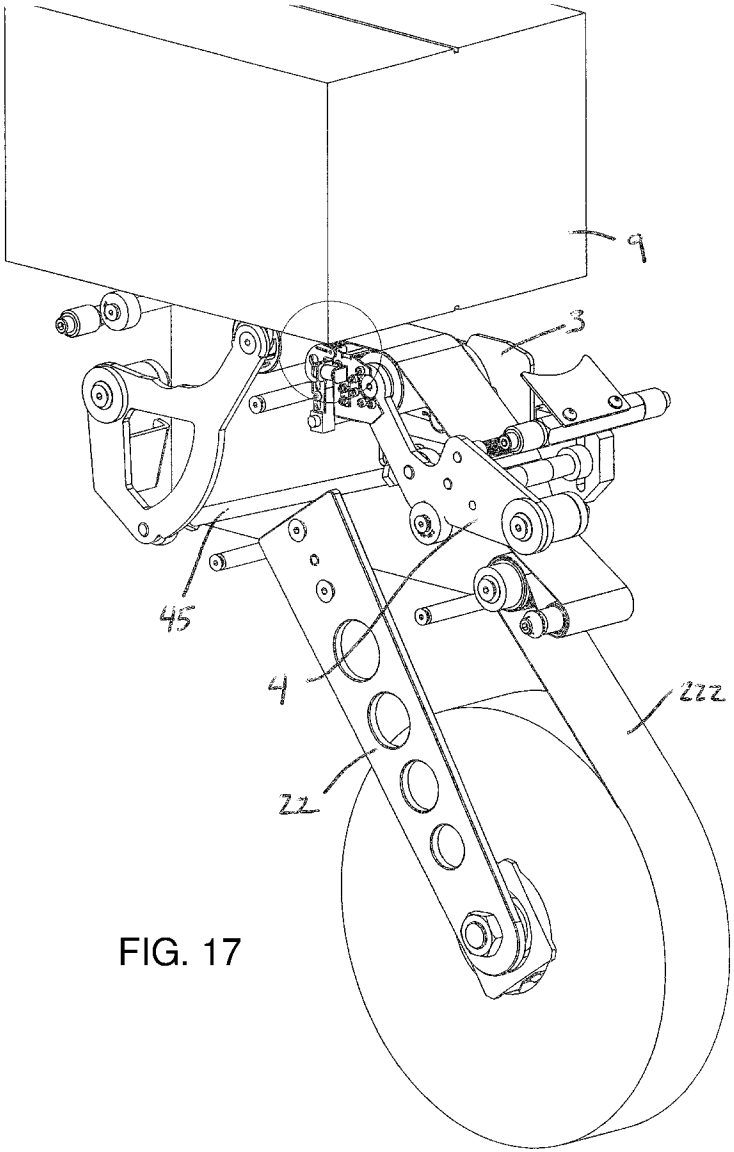

In FIGS. 17 and 17A, the case 9 continues to pass into the adhesive tape 222 and the bottom major flaps of the case 9 is sealed and the ear-shape flip bar weldment 52 maintains the knocked down position. As the case 9 passes over the front roller plate 4, it keeps the knife cutting plate 6 down by pressing the case sensing basket 62 (not shown) down and prevents the knife 61 from cutting the adhesive tape 222. When the case 9 has passed completely past the case sensing basket 62 per FIGS. 18 and 18A, the knife cutting plate 6 pops up to its original position, and the knife 61 mounted on the knife cutting plate 6 also pops up and cuts the adhesive tape 222.

Figure 19A:
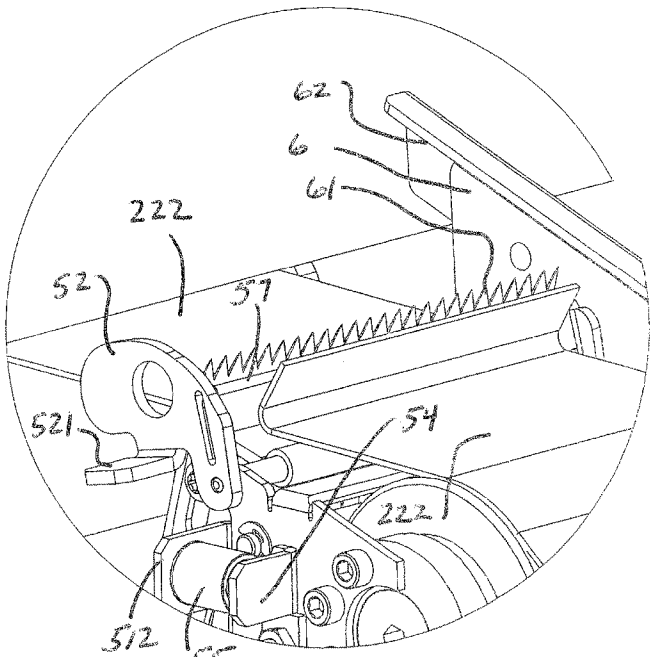
Figure 19:
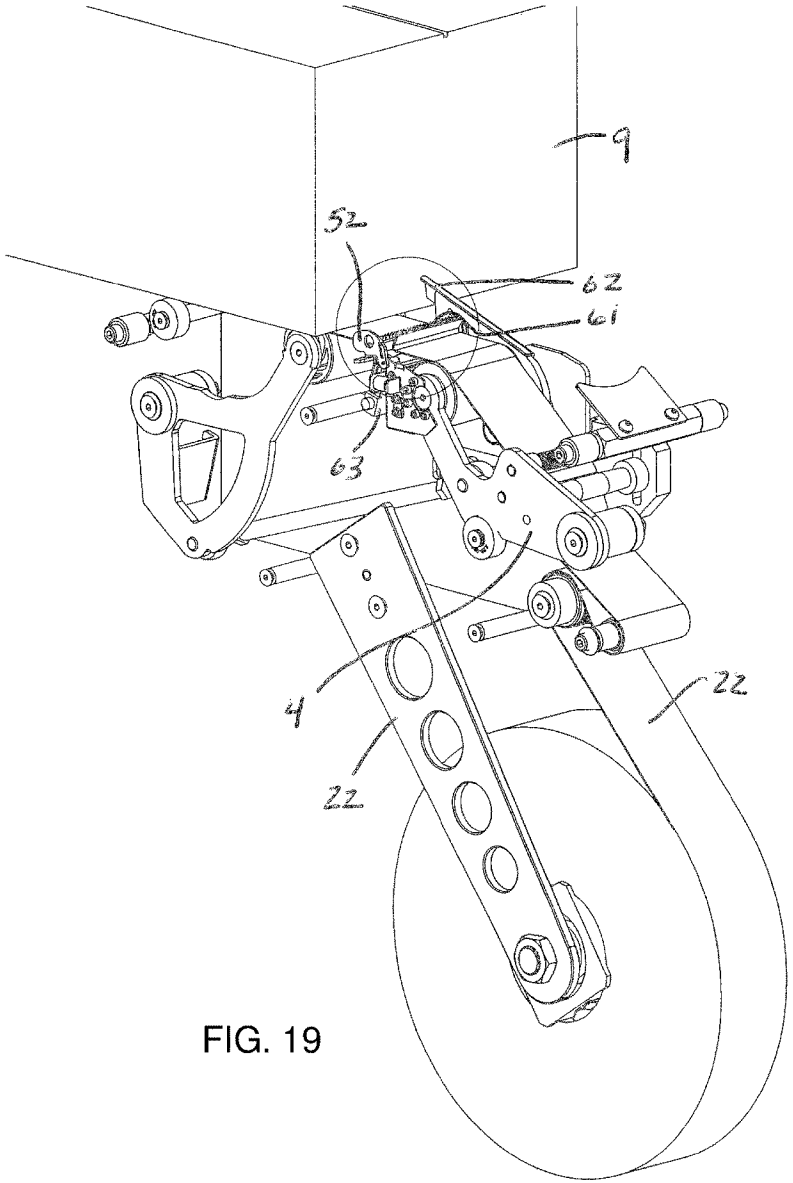

Continuing in FIGS. 19 and 19A, when the pop up of the knife cutting plate 6 lifts up the knife 61 and the knife mounting block 63, on one side, the knife 61 cuts the adhesive tape 222 and on the other side, the knife mounting block 63 knocks against the ear-shape flip bar weldment 52 at the time of bounce back, overcoming the magnetic catch and forcing the ear-shape flip bar weldment 52 to separate from the flip bar support basket 51. The bounce back of the ear-shape flip bar weldment 52 causes the U-shape flip bar 57 to hit the adhesive tape end that is still attached to the tape roll and causes it to fold up as shown in FIG. 19A.

Figure 20A:
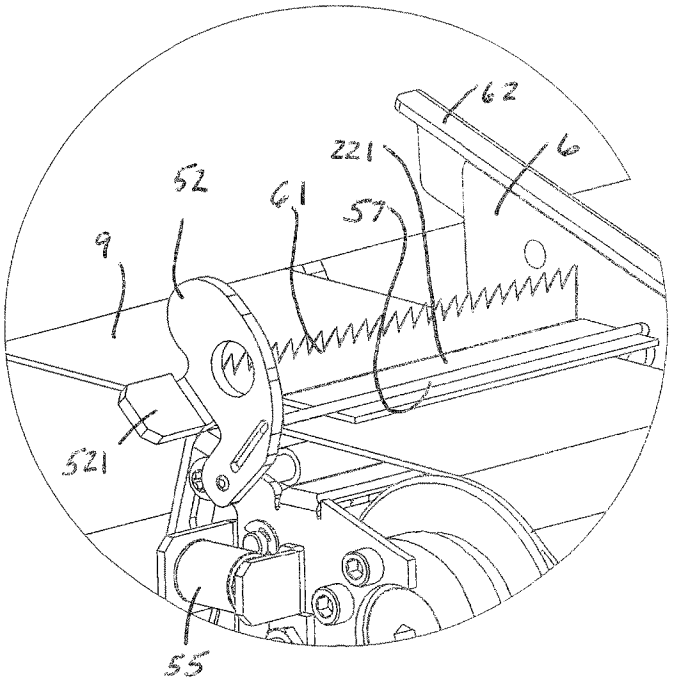
Figure 20:
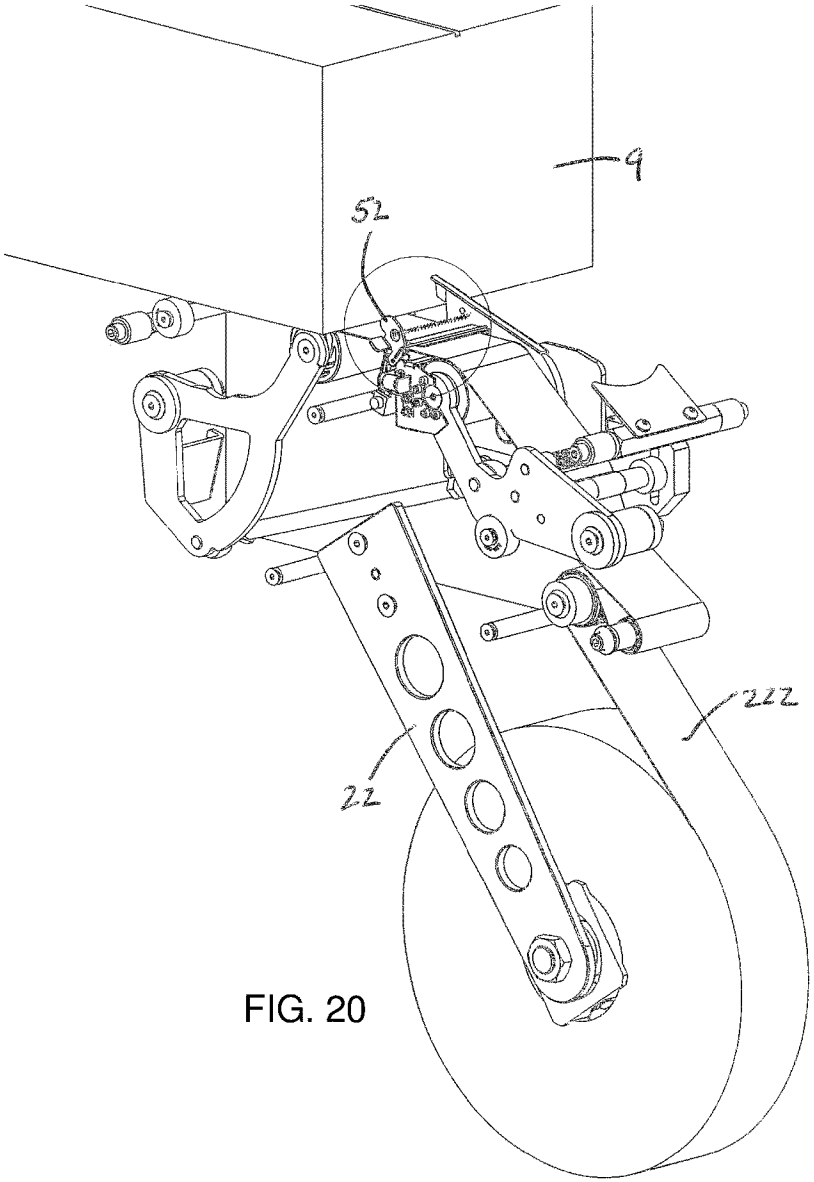
Figure 21A:
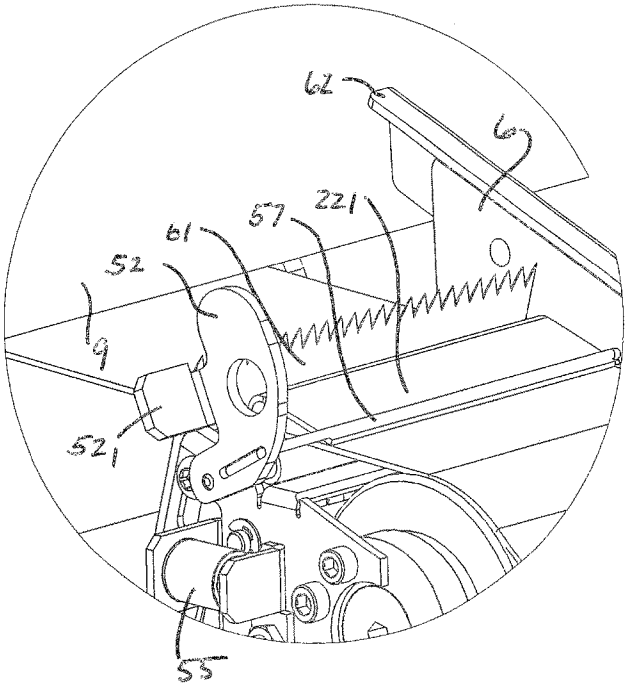
Figure 21:
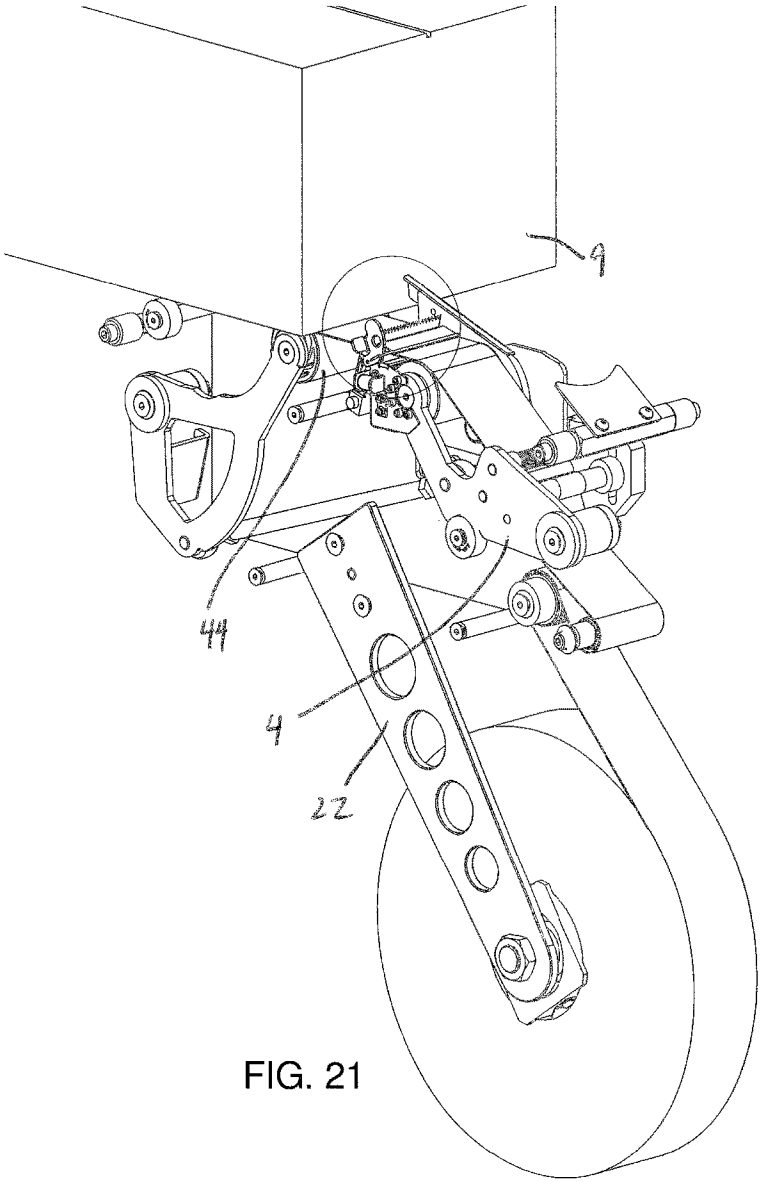
Figure 22A:
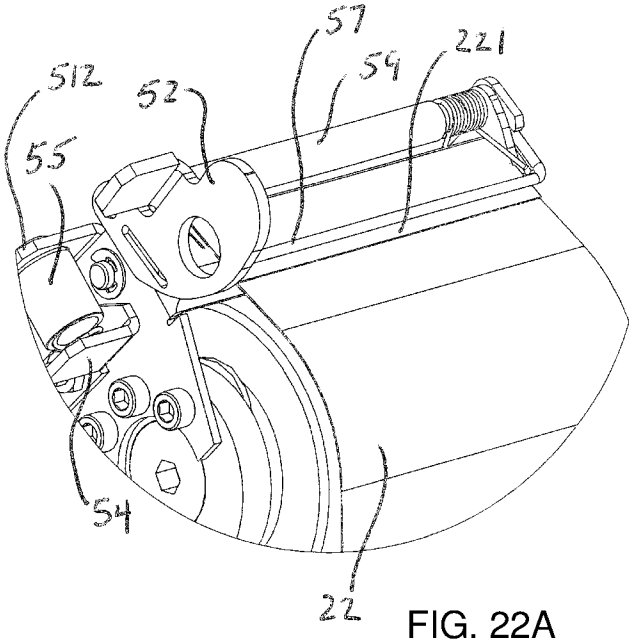
Figure 22:
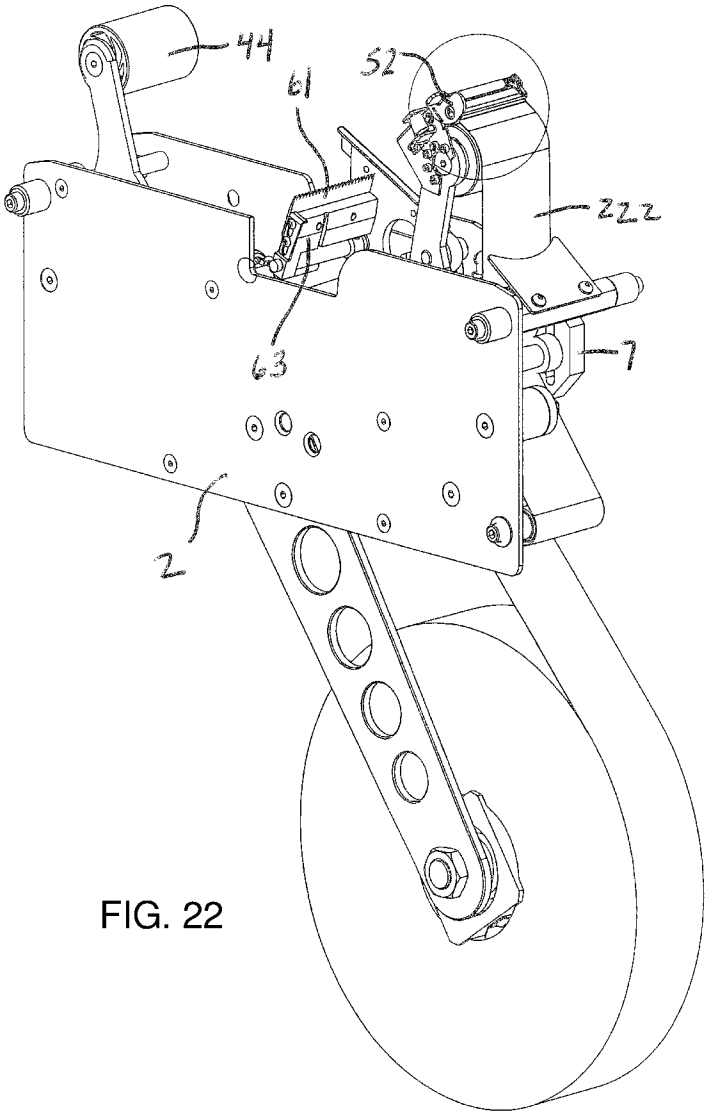

As illustrated in FIG. 20-21, the U-shape flip bar 57 continues to move the adhesive tape end to fold up and bring the adhesive side back in contact with itself to form a non-adhesive front tape end fold 221. Finally, after the case 9 passes beyond the back roller 44, the roller 44 moves upward to apply the free end of the cut tape to the trailing panel of the case, and per FIGS. 22 and 22A the adhesive tape application device 1 returns to the ready to work position with a non-adhesive tape front end 221 held by the U-shape flip bar 57 of the non-adhesive tape forming device 5 to prevent the adhesive tape from dropping down or moving to an improper sealing position because of gravity or thinner tape quality. The arrangement then waits for the coming of a new case 9 in order to repeat the tape applying cycle.

Thus, an advantageous tape applicator device is provided that can be used in case sealing machines to automatically produce sealed cases in which one end of the tape used to seal the case include a grippable tape removal flap that is located on a panel side of the case (e.g., on the leading panel, but not on a flap side of the case). In particular, a tape applicator includes a tape applying roller (e.g., roller 43) for holding an adhesive side of tape against the case during tape application. A tape fold over mechanism (e.g., flip bar 57) is associated with the tape applying roller and is movable from a non-fold over position (e.g., per FIG. 16A) away from the tape applying roller to a fold over position (e.g., per FIG. 21A) toward the tape applying roller. A tape travel path extends past the fold over mechanism when the mechanism is in the non-fold over position (e.g., per FIG. 18A) and the fold over mechanism moves across the tape travel path when moving from the non-fold over position to the fold over position (e.g., per the sequence of FIGS. 19A, 20A and 21A).

Figure 18A:
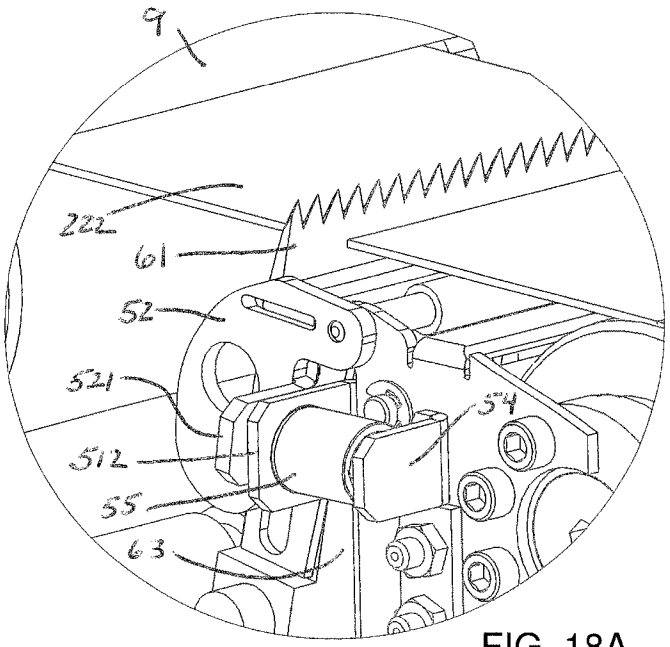
Figure 18:
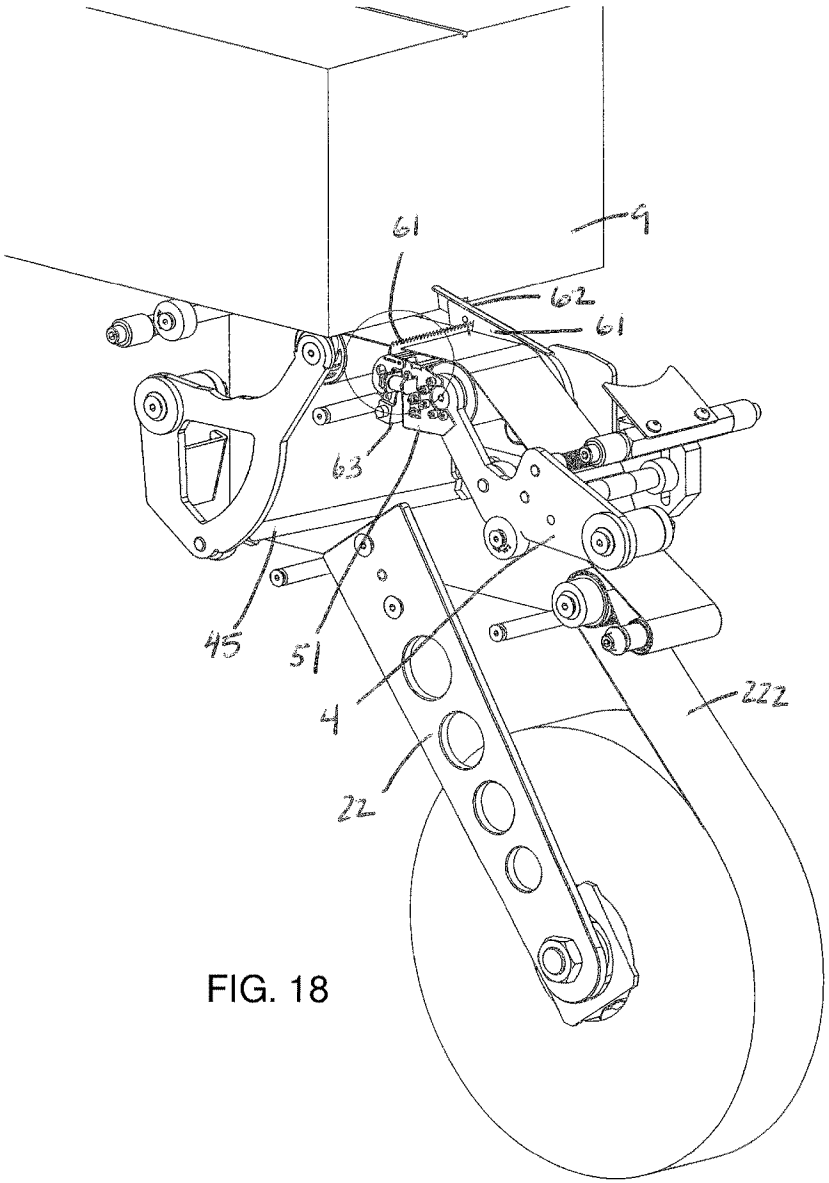

In one implementation, a tape cutter (e.g., knife 61) is located downstream (e.g., in the direction of case travel and tape travel) of the fold over mechanism and is movable through the tape travel path for cutting tape and forming a free tape end (e.g., per FIG. 18A). Movement of the fold over mechanism from the non-fold over position to the fold over position causes the free tape end to fold upon and adhere to itself to create a non-adhesive grip flap (e.g., per FIGS. 19A, 20A and 21A).

The fold over mechanism may be biased into the fold over position (e.g., by a torsion spring on spring holding bar 59). A releasable catch (e.g., per the magnetic catch of FIG. 16A) may be provided for holding the fold over mechanism in the non-fold over position. The tape cutter is configured to release the releasable catch when the tape cutter moves through the tape travel path, causing the fold over mechanism to automatically move from the non-fold over position to the fold over position.

In the primary embodiment, the releasable catch is a magnetic catch (e.g., including magnet 551) and the tape cutter exerts a force on the fold over mechanism that overcomes the magnetic catch.

In one implementation, a tape support surface (e.g., surface of backing pad 58) is positioned proximate the tape applying roller. When the fold over mechanism is in the fold over position it is urged toward the tape support surface to hold a folded over tape end against the tape support surface (e.g., per FIG. 12A).

In one implementation, a distance from the tape cutter to the fold over mechanism is adjustable to vary a size of the non-adhesive grip flap that is produced (e.g., per adjustment of the position of the knife mounting plate 31 adjustable along slots 32).

The tape applicator device is mountable within a case sealing machine (e.g., the machine of FIG. 1) that includes a conveying mechanism for moving cases along a case travel path past the tape applicator device. By way of example, the tape applicator device may be positioned and arranged to seal either a bottom of the case or a top of the case, or a machine may include both an upper and lower applicator for sealing both the top and bottom flap sides of the case.

From the above description it is apparent that an advantageous case taping method is provided. In particular, a method of taping a case involves moving the case along a case travel path of a case sealing machine. A tape applicator device presents a free end of a tape supply into the case travel path, wherein the free end includes a non-adhesive end flap portion formed by an end fold over. A leading panel of the case contacts the free end and the portion of the free end adjacent the non-adhesive end flap portion adheres to the leading panel at an initial adhesion point, but with the non-adhesive end flap portion not adhered to create a grippable tape removal flap. Continued movement of the case causes the tape to be applied from the initial adhesion point toward and onto a flap side of the case and then along the flap side of the case with one side of the tape adhering to an edge of a first flap and another side of the tape adhering to an edge of a second flap. As the flap side of the case clears the tape applicator device tape is applied from the flap side onto a trailing panel of the case. The tape is cut to complete a length of tape being applied to the case and to create a new free end of the tape supply. The new free end of the tape supply is automatically folded over upon itself to form another non-adhesive end flap portion in preparation for a next case taping operation.

In one implementation of the method, movement of the case into the tape applicator device causes at least a portion of the tape applicator device to shift during tape application. A knife component includes a knife mounted on a pivotable carrying bracket that is contacted by the case to hold the knife in a position retracted from a tape travel path, when the case clears the bracket, the bracket pivots so as to move the knife through the tape travel path and cut the tape, and movement of the bracket also triggers a tape folding bar that folds over the new free end of the tape.

In one implementation of the method, the method includes presenting the new free end with non-adhesive portion into the case travel path.

In one implementation of the method, movement of a knife component to cut the tape triggers a fold over mechanism to fold the new free end of the tape.

In one implementation of the method, the fold over mechanism is biased toward a fold over position, the fold over mechanism is held in a non-folder over position by a releasable catch until the knife component causes release of the catch.

In one implementation of the method, the releasable catch is a magnetic catch and the knife component exerts a force on the fold over mechanism that overcomes the magnetic catch.

In one implementation of the method, the fold over mechanism is mounted for pivotal movement between a non-fold over position and a fold over position.

In one implementation of the method, the knife component is located downstream of a first tape applying roller and the fold over mechanism is located between the first tape applying roller and the knife component.

In one implementation of the method, a position of the knife component is adjustable to and such adjustment sets fold over size.

In one implementation of the method, a second tape applying roller is located downstream of the knife component for completing tape application to the case after cutting of the tape.

In one implementation of the method, the non-adhesive portion has a length of between about ½ inch and about 3 inches and the another non-adhesive portion has a length of between about ½ inch and about 3 inches.

In one implementation of the method, side portions of the length of tape applied to the case are adhesive along the length of tape with the exception of the non-adhesive end flap portion.

It is to be clearly understood that the above description is intended by way of illustration and example only, is not intended to be taken by way of limitation, and that other changes and modifications are possible.

What is claimed is:

1. A method of taping a case, comprising:

moving the case along a case travel path of a case sealing machine;

a tape applicator device presenting a free end of a tape supply into the case travel path, wherein the free end includes a non-adhesive end flap portion formed by an end fold over;

a leading panel of the case contacts the free end and a portion of the free end adjacent the non-adhesive end flap portion adheres to the leading panel at an initial adhesion point but with the non-adhesive end flap portion not adhered to create a grippable tape removal flap;

continued movement of the case causes the tape to be applied from the initial adhesion point toward and onto a flap side of the case and then along the flap side of the case with one side of the tape adhering to an edge of a first flap and another side of the tape adhering to an edge of a second flap;

as the flap side of the case clears the tape applicator device, tape is applied from the flap side onto a trailing panel of the case;

cutting the tape to complete a length of tape being applied to the case and to create a new free end of the tape supply; and automatically folding over the new free end of the tape supply upon itself to form another non-adhesive end flap portion in preparation for a next case taping operation;

wherein movement of a knife component to cut the tape triggers a fold over mechanism to fold the new free end of the tape;

wherein the fold over mechanism is biased toward a fold over position, the fold over mechanism is held in a non-fold over position by a releasable catch until the knife component causes release of the catch.

2. The method of claim 1 wherein:

movement of the case into the tape applicator device causes at least a portion of the tape applicator device to shift during tape application;

the knife component includes a knife mounted on a pivotable carrying bracket that is contacted by the case to hold the knife in a position retracted from a tape travel path, when the case clears the carrying bracket, the carrying bracket pivots so as to move the knife through the tape travel path and cut the tape, and movement of the carrying bracket also triggers a tape folding bar that folds over the new free end of the tape.

3. The method of claim 1 including presenting the new free end with non-adhesive end flap portion into the case travel path.

4. The method of claim 1 wherein the releasable catch is a magnetic catch and the knife component exerts a force on the fold over mechanism that overcomes the magnetic catch.

5. The method of claim 1 wherein the fold over mechanism is mounted for pivotal movement between a non-fold over position and a fold over position.

6. The method of claim 1 wherein the knife component is located downstream of a first tape applying roller and the fold over mechanism is located between the first tape applying roller and the knife component.

7. The method of claim 6 wherein a position of the knife component is adjustable and such adjustment sets fold over size.

8. The method of claim 6 wherein a second tape applying roller is located downstream of the knife component for completing tape application to the case after cutting of the tape.

9. The method of claim 1 wherein the non-adhesive end flap portion has a length of between about ½ inch and about 3 inches and the another non-adhesive end flap portion has a length of between about ½ inch and about 3 inches.

10. The method of claim 1 wherein side portions of the length of tape applied to the case are adhesive along the length of tape with the exception of the non-adhesive end flap portion.

11. A method of taping a case, comprising:

a tape applicator device presenting a free end of a tape supply into a case travel path along which a case moves through a case sealing machine, wherein the free end includes a non-adhesive end flap portion formed by an end fold over;

a leading panel of the case contacts the free end and a portion of the free end adjacent the non-adhesive end flap portion adheres to the leading panel but with the non-adhesive end flap portion not adhered to create a grippable tape removal flap;

continued movement of the case causes the tape to be applied on the case toward and onto a flap side of the case and then along the flap side of the case with one side of the tape adhering to an edge of a first case flap and another side of the tape adhering to an edge of a second case flap;

continued movement of the case causes the tape to be applied from the flap side onto a trailing panel of the case;

cutting the tape to complete a length of tape being applied to the case and to create a new free end of the tape supply; and automatically folding over the new free end of the tape supply upon itself to form another non-adhesive end flap portion in preparation for a next case taping operation;

wherein movement of a knife component to cut the tape triggers a fold over mechanism to fold the new free end of the tape;

wherein the fold over mechanism is biased toward a fold over position, the fold over mechanism is held in a non-fold over position by a releasable catch until the knife component causes release of the catch.

12. The method of claim 11 including presenting the new free end with the another non-adhesive end flap portion into the case travel path.

13. The method of claim 12 wherein the releasable catch is a magnetic catch and the knife component exerts a force on the fold over mechanism that overcomes the magnetic catch.

* * * * *